US011545295B2

(12) United States Patent
Igarashi

(10) Patent No.: US 11,545,295 B2
(45) Date of Patent: Jan. 3, 2023

(54) COIL COMPONENT

(71) Applicant: Murata Manufacturing Co., Ltd., Kyoto-fu (JP)

(72) Inventor: Akio Igarashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 477 days.

(21) Appl. No.: 16/721,647

(22) Filed: Dec. 19, 2019

(65) Prior Publication Data

US 2020/0243250 A1 Jul. 30, 2020

(30) Foreign Application Priority Data

Jan. 28, 2019 (JP) ..... JP2019-012035

(51) Int. Cl.
*H01F 27/28* (2006.01)
*H01F 27/29* (2006.01)
*H01F 27/24* (2006.01)

(52) U.S. Cl.
CPC ..... *H01F 27/2823* (2013.01); *H01F 27/24* (2013.01); *H01F 27/292* (2013.01)

(58) Field of Classification Search
CPC .... H01F 27/2823; H01F 27/24; H01F 27/292; H01F 3/10; H01F 19/08; H01F 27/2828
See application file for complete search history.

(56) References Cited

U.S. PATENT DOCUMENTS

2009/0219127 A1* 9/2009 Tomonari ..... H01F 27/29 336/192
2014/0306789 A1* 10/2014 Hirai ..... H01F 17/045 336/188
2015/0371766 A1* 12/2015 Kawasaki ..... H01F 17/045 336/212
2017/0294264 A1* 10/2017 Hashimoto ..... H01F 27/29
2018/0211763 A1* 7/2018 Komaya ..... H01F 27/2828

FOREIGN PATENT DOCUMENTS

JP 2012-248610 A 12/2012

* cited by examiner

*Primary Examiner* — Lincoln D Donovan
*Assistant Examiner* — Alex W Lam
(74) *Attorney, Agent, or Firm* — Studebaker & Brackett PC

(57) ABSTRACT

A coil component includes first and second wires wound around a winding core portion of a core, and third and fourth wires wound around outside a portion of the first and the second wires wound around the winding core portion in an opposite direction to a winding direction of the first and second wires. The portion of the first and second wires wound around the winding core portion has a first twisted wire portion twisted together. A length of the first wire or a length of the second wire of the portion of the first and second wires wound around the winding core portion is configured to be equal to a length of the third wire or a length of the fourth wire of the portion of the third and fourth wires wound around outside the portion of the first and second wires wound around the winding core portion.

20 Claims, 12 Drawing Sheets

COIL COMPONENT

CROSS-REFERENCE TO RELATED APPLICATIONS

This application claims benefit of priority to Japanese Patent Application No. 2019-012035, filed Jan. 28, 2019, the entire content of which is incorporated herein by reference.

BACKGROUND

Technical Field

The present disclosure relates to a coil component.

Background Art

As a coil component, an existing surface-mount type pulse transformer has been known in which a first wire and a second wire are bifilar-wound around a winding core portion of a core, and a third wire and a fourth wire are bifilar-wound on the first wire and the second wire, as described, for example, Japanese Unexamined Patent Application Publication No. 2012-248610. In the pulse transformer disclosed in Japanese Unexamined Patent Application Publication No. 2012-248610, since positions of the first wire and the second wire in one turn closest to one end or another end of the winding core portion are reversed relative to positions of the other turns, an insertion loss of the pulse transformer in a use frequency band is increased, thereby making it possible to substitute for a notch filter.

Incidentally, in Japanese Unexamined Patent Application Publication No. 2012-248610, since this reversal technique is substituted for the notch filter in a specific use frequency band (62.5 MHz), for example, a signal waveform in a system using a plurality of frequencies may attenuate and the communication quality may deteriorate.

SUMMARY

Accordingly, the present disclosure provides a coil component capable of improving versatility for a communication band.

A coil component according to an aspect of the present disclosure includes a core having a winding core portion, a first wire and a second wire wound around the winding core portion, and a third wire and a fourth wire wound around an outer side portion of a portion of the first wire and the second wire wound around the winding core portion in a direction opposite to a winding direction of the first wire and the second wire. A portion of the first wire and the second wire wound around the winding core portion has, at least in part, a first twisted wire portion in which the first wire and the second wire are twisted each other, and a length of a portion of the first wire and the second wire wound around the winding core portion such that the first wire and the second wire are adjacent to each other is configured to be equal to a length of a portion of the third wire and the fourth wire wound around an outer side portion of a portion of the first wire and the second wire wound around the winding core portion such that the third wire and the fourth wire are adjacent to each other.

According to this configuration, since the lengths of adjacent first wire and second wire wound around the winding core portion of the core are equal to the lengths of adjacent third wire and fourth wire wound around the outer side portion of the portion of the first wire and the second wire wound around the winding core portion, a difference of a stray capacitance between the first wire and the second wire from a stray capacitance between the third wire and the fourth wire is reduced. In addition, the first twisted wire portion is formed by the first wire and the second wire, thereby reducing a leakage inductance between the first wire and the second wire. As described above, the stray capacitance difference and the leakage inductance are reduced, so that insertion loss in the entire frequency band is reduced. Therefore, it is possible to improve versatility of the coil component for the communication band.

Other features, elements, characteristics and advantages of the present disclosure will become more apparent from the following detailed description of preferred embodiments of the present disclosure with reference to the attached drawings.

DETAILED DESCRIPTION

Hereinafter, an embodiment will be described.

It should be noted that the accompanying drawings may enlarge and illustrate constituent elements in order to facilitate understanding. A dimensional ratio of the constituent elements may be different from actual or different from that in the other figures. In addition, in the cross-sectional view, hatching of some constituent elements may be omitted for ease of understanding.

Figure 1:
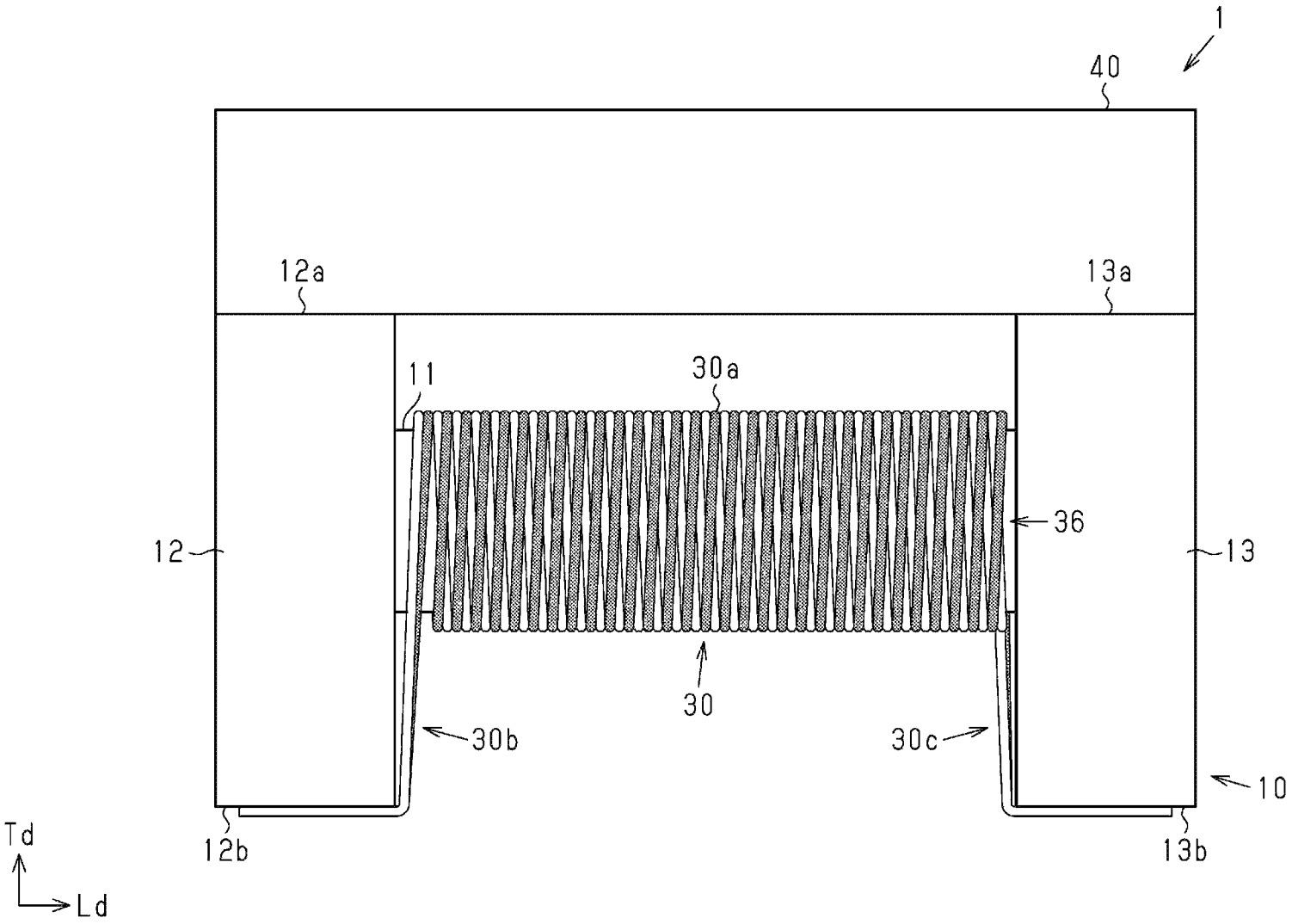
FIG. 1 is a schematic side view illustrating a coil component according to an embodiment.
Figure 2:
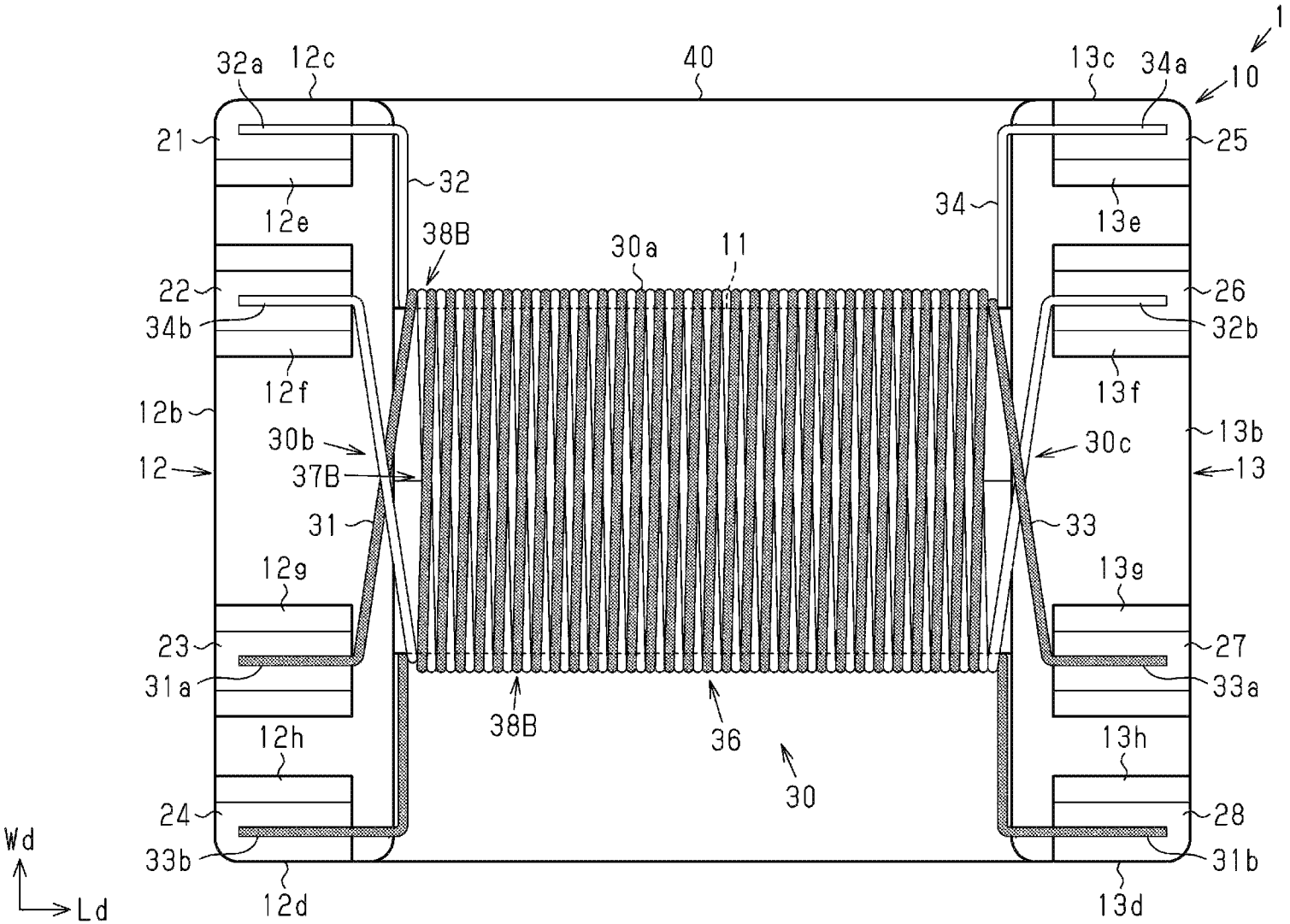
FIG. 2 is a schematic bottom view illustrating a coil component according to an embodiment.

As illustrated in FIG. 1 and FIG. 2, a coil component 1 includes a core 10 and a coil 30 wound around the core 10. The coil component 1 is, for example, a surface-mount type coil component. The coil component 1 is used, for example, as a signal transformer. The coil component 1 is not limited to a signal transformer, and may be a common mode choke coil, a balun (balanced-to-unbalanced converter), or an inductor array.

The core 10 is made of a non-conductive material, specifically, a non-magnetic material such as alumina, a magnetic material such as nickel (Ni)-zinc (Zn) base ferrite, or the like. The core 10 is formed, for example, by firing a molded body obtained by compressing the non-conductive material. The core 10 is not limited to those formed by firing a molded body obtained by compressing a non-conductive material, and may be formed by thermal-solidifying a resin containing magnetic powder such as metal powder, ferrite powder or the like, a resin containing non-magnetic powder such as silica powder, or a resin containing no filler.

Figure 3:
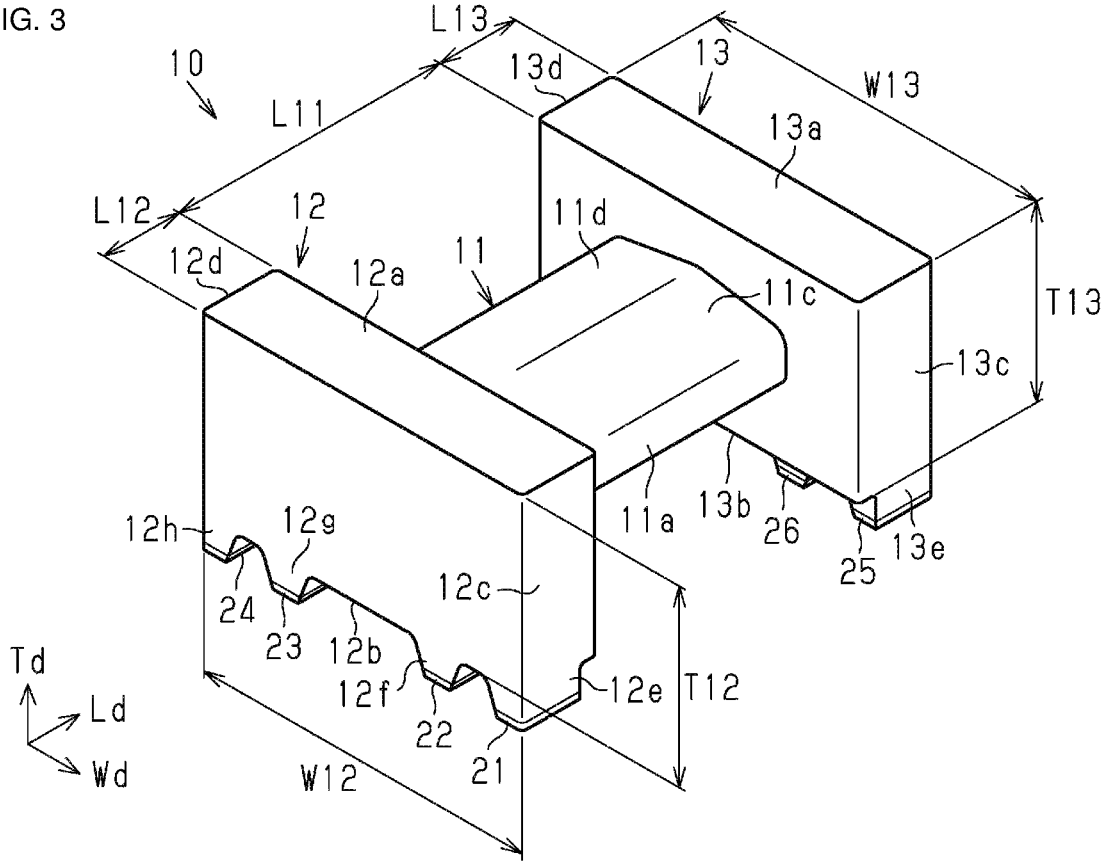
FIG. 3 is a perspective view illustrating a core.

As illustrated in FIG. 3, the core 10 includes a winding core portion 11 extending in a predetermined direction, a first flange portion 12 provided at a first end portion of the winding core portion 11 in the predetermined direction, and a second flange portion 13 provided at a second end portion which is an end portion on the opposite side of the first end portion of the winding core portion 11 in the predetermined direction. In the present embodiment, the winding core portion 11, the first flange portion 12, and the second flange portion 13 are integrally formed. In the following description, a predetermined direction in which the winding core portion 11 extends is referred to as a "length direction Ld", a direction orthogonal to the length direction Ld in a plan view of the core 10 is referred to as a "width direction Wd", and a direction orthogonal to the length direction Ld and the width direction Wd is referred to as a "height direction Td". The length direction Ld can also be referred to as an arrangement direction of the first flange portion 12 and the second flange portion 13. In addition, the width direction Wd can be referred to as a direction parallel to a main surface of a circuit substrate in a state in which the coil component 1 is mounted in or on the circuit substrate, of directions perpendicular to the length direction Ld. The height direction Td can be referred to as a direction perpendicular to the main surface of the circuit substrate in a state in which the coil component 1 is mounted in or on the circuit substrate, of the directions perpendicular to the length direction Ld.

Figure 4:
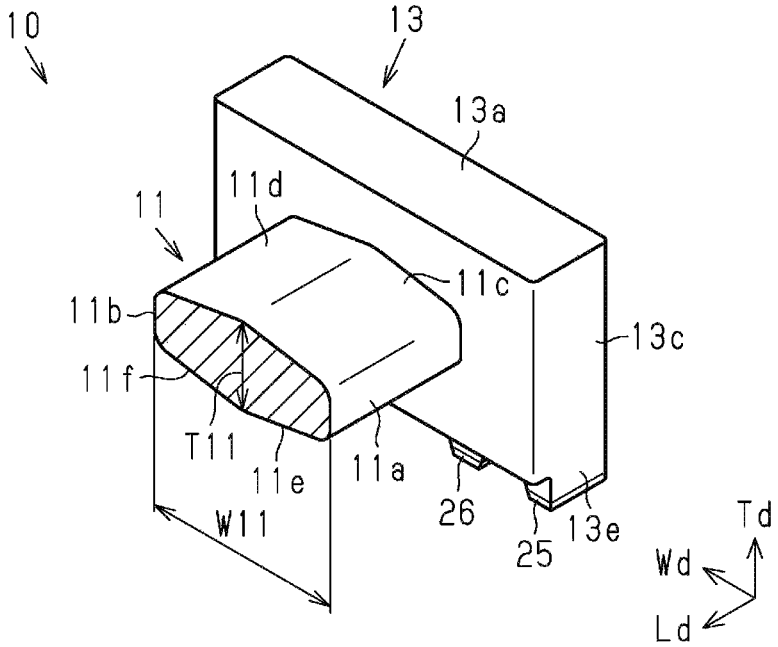
FIG. 4 is a cross-sectional perspective view illustrating a winding core portion of the core.

As illustrated in FIG. 3 and FIG. 4, a dimension L11 in the length direction Ld of the winding core portion 11 is larger than a dimension W11 in the width direction Wd of the winding core portion 11 and a dimension T11 in the height direction Td of the winding core portion 11. The dimension W11 in the width direction Wd of the winding core portion 11 is larger than the dimension T11 in the height direction Td of the winding core portion 11. Here, the dimension T11 in the height direction Td of the winding core portion 11 indicates the maximum dimension of the winding core portion 11 in the height direction Td.

As illustrated in FIG. 4, it is preferable that a cross-sectional shape of the winding core portion 11 cut by a plane orthogonal to the extending direction of the winding core portion 11, that is, a cross-sectional shape in which the winding core portion 11 is cut by a plane parallel to the height direction Td and the width direction Wd (hereinafter, simply referred to as a cross-sectional shape of the winding core portion 11) be a substantially polygonal shape. In the present embodiment, the cross-sectional shape of the winding core portion 11 is substantially hexagonal. In this specification, a "polygonal shape" includes a shape in which a corner portion is chamfered, a shape in which a corner portion is rounded, a shape in which a part of each side has a substantially curved shape, and the like.

The winding core portion 11 has a pair of side surfaces 11*a* and 11*b* of two surfaces facing the width direction Wd, and a pair of first surfaces 11*c* and 11*d* and a pair of second surfaces 11*e* and 11*f* of four surfaces facing the height direction Td. The side surface 11*a* and the side surface 11*b* are formed so as to be parallel to each other with a space in the width direction Wd. The first surfaces 11*c* and 11*d* and the second surfaces 11*e* and 11*f* are formed so as to be spaced apart from each other in the height direction Td. An angle formed by the side surface 11*a* and the first surface 11*c*, an angle formed by the side surface 11*a* and the second surface 11*e*, an angle formed by the side surface 11*b* and the first surface 11*d*, and an angle formed by the side surface 11*b* and the second surface 11*f* are equal to one another, for example, about 100 degrees. An angle formed by the first surface 11*c* and the first surface 11*d* and an angle formed by the second surface 11*e* and the second surface 11*f* are equal to each other, and are, for example, about 160 degrees. The angle formed by the side surface 11*a* and the first surface 11*c*, the angle formed by the side surface 11*a* and the second surface 11*e*, the angle formed by the side surface 11*b* and the first surface 11*d*, and the angle formed by the side surface 11*b* and the second surface 11*f* can be arbitrarily changed respectively. For example, the angle formed by the side surface 11*a* and the first surface 11*c*, the angle formed by the side surface 11*a* and the second surface 11*e*, the angle formed by the side surface 11*b* and the first surface 11*d*, and the angle formed by the side surface 11*b* and the second surface 11*f* may be different from one another. The angle formed by the first surface 11*c* and the first surface 11*d* and the angle formed by the second surface 11*e* and the second surface 11*f* can be arbitrarily changed respectively. For example, the angle formed by the first surface 11*c* and the first surface 11*d*, and the angle formed by the second surface 11*e* and the second surface 11*f* may be different from each other.

As illustrated in FIG. 1 to FIG. 3, a shape of the first flange portion 12 is substantially the same as a shape of the second flange portion 13. As illustrated in FIG. 3, widths W12 and W13 of the first flange portion 12 and the second flange portion 13 in the width direction Wd are larger than dimensions T12 and T13 of the first flange portion 12 and the second flange portion 13 in the height direction Td. The dimensions T12 and T13 of the first flange portion 12 and the second flange portion 13 in the height direction Td are larger than dimensions L12 and L13 of the first flange portion 12 and the second flange portion 13 in the length direction Ld. The widths W12 and W13 in the width direction Wd of the first flange portion 12 and the second flange portion 13 are larger than the dimension W11 in the width direction Wd of the winding core portion 11, and the dimensions T12 and T13 in the height direction Td of the first flange portion 12 and the second flange portion 13 are larger than the dimension T11 in the height direction Td of the winding core portion 11 (see FIG. 4). The dimension T12 in the height direction Td of the first flange portion 12 is a dimension of a portion in the height direction Td from the first flange portion 12 excluding protrusions 12*e*, 12*f*, 12*g*, and 12*h*, a first terminal electrode 21, a second terminal electrode 22, a third terminal electrode 23, and a fourth terminal electrode 24, which will be described later. The dimension T13 in the height direction Td of the second flange portion 13 is a dimension of a portion in the height direction Td from the second flange portion 13 excluding protrusions 13*e*, 13*f*, 13*g*, and 13*h*, a fifth terminal electrode 25, a sixth terminal electrode 26, a seventh terminal electrode 27, and an eighth terminal electrode 28, which will be described later.

As illustrated in FIG. 1 to FIG. 3, the first flange portion 12 includes a first surface 12*a* and a second surface 12*b* facing the height direction Td, and a pair of side surfaces 12*c* and 12*d* facing the width direction Wd. Four protrusions 12*e*, 12*f*, 12*g*, and 12*h* protruding from the second surface 12*b* in the height direction Td are provided in the first flange portion 12. The four protrusions 12*e*, 12*f*, 12*g*, and 12*h* are arranged so as to be spaced apart from one another in the width direction Wd. The first terminal electrode 21 is provided at a tip portion of the protrusion 12*e*, the second terminal electrode 22 is provided at a tip portion of the protrusion 12*f*, the third terminal electrode 23 is provided at a tip portion of the protrusion 12*g*, and the fourth terminal electrode 24 is provided at a tip portion of the protrusion 12*h*. The shape of each of the terminal electrodes 21 to 24 in a plan view is a substantially rectangular shape in which the dimension in the length direction Ld is larger than the dimension in the width direction Wd. Each of the terminal electrodes 21 to 24 is arranged from the side surface 12*c* toward the side surface 12*d*, in the order of the first terminal electrode 21, the second terminal electrode 22, the third terminal electrode 23, and the fourth terminal electrode 24. The first terminal electrode 21 and the fourth terminal electrode 24 are provided at an end portion in the width direction Wd of the first flange portion 12. The first terminal electrode 21 and the fourth terminal electrode 24 are located at an outer side portion relative to the winding core portion 11 in the width direction Wd. A distance between the second terminal electrode 22 and the third terminal electrode 23 in the width direction Wd is larger than each of a distance between the first terminal electrode 21 and the second terminal electrode 22 in the width direction Wd and a distance between the third terminal electrode 23 and the fourth terminal electrode 24 in the width direction Wd.

The second flange portion 13 includes a first surface 13*a* and a second surface 13*b* facing the height direction Td, and a pair of side surfaces 13*c* and 13*d* facing the width direction Wd. Four protrusions 13*e*, 13*f*, 13*g*, and 13*h* protruding from the second surface 13*b* in the height direction Td are provided in the second flange portion 13. The four protrusions 13*e*, 13*f*, 13*g*, and 13*h* are arranged and spaced apart from one another in the width direction Wd. The fifth terminal electrode 25 is provided at a tip portion of the protrusion 13*e*, the sixth terminal electrode 26 is provided at a tip portion of the protrusion 13*f*, a seventh terminal electrode 27 is provided at a tip portion of the protrusion 13*g*, and the eighth terminal electrode 28 is provided at a tip portion of the protrusion 13*h*. The shape of each of the terminal electrodes 25 to 28 in a plan view is a substantially rectangular shape in which the dimension in the length direction Ld is larger than the dimension in the width direction Wd. The terminal electrodes 25 to 28 are respectively arranged from the side surface 13*c* toward the side surface 13*d*, in the order of the fifth terminal electrode 25, the sixth terminal electrode 26, the seventh terminal electrode 27, and the eighth terminal electrode 28. The fifth terminal electrode 25 and the eighth terminal electrode 28 are provided at an end portion in the width direction Wd of the second flange portion 13. The fifth terminal electrode 25 and the eighth terminal electrode 28 are located at the outer side portion relative to the winding core portion 11 in the width direction Wd. A distance between the sixth terminal electrode 26 and the seventh terminal electrode 27 in the width direction Wd is larger than each of a distance between the fifth terminal electrode 25 and the sixth terminal electrode 26 in the width direction Wd and a distance between the seventh terminal electrode 27 and the eighth terminal electrode 28 in the width direction Wd.

Each of the terminal electrodes 21 to 28 is formed by applying a conductive paste containing silver (Ag) as a conductive component and baking it or formed by sputtering nickel (Ni)-chromium (Cr), nickel (Ni)-copper (Cu), or the like. In addition, a plating film may be further formed as needed. As a material for the plating film, for example, a metal such as tin (Sn), Cu, Ni or the like, or an alloy such as Ni—Sn may be used. Alternatively, the plating film may have a multilayer structure.

As illustrated in FIG. 1 and FIG. 2, a substantially rectangular parallelepiped plate-like member 40 is attached to the core 10 of the present embodiment. The plate-like member 40 is provided so as to connect the first surface 12*a* of the first flange portion 12 to the first surface 13*a* of the second flange portion 13. Incidentally, the plate-like member 40 may be omitted. The plate-like member 40 is made of a non-conductive material, specifically, a non-magnetic material such as alumina, a magnetic material such as nickel (Ni)-zinc (Zn) base ferrite, or the like. The core 10 is formed, for example, by firing a molded body obtained by compressing the non-conductive material. The plate-like member 40 is not limited to a member formed by firing a molded body obtained by compressing a non-conductive material, and for example, a resin containing magnetic powder such as metal powder or ferrite powder, a resin containing non-magnetic powder such as silica powder, or a resin containing no filler may be formed by thermal-solidifying.

An outer surface of the substantially rectangular parallelepiped plate-like member 40 serves as a suction surface when the coil component 1 is moved. For this reason, for example, when the coil component 1 is mounted in or on the circuit substrate, the coil component 1 is easily moved on the circuit substrate by the suction and conveyance device. Similarly to the core 10, the plate-like member 40 may be made of the magnetic material, and when the plate-like member 40 is made of the magnetic material, the core 10 may cooperate with the plate-like member 40 to form a closed magnetic path, thereby improving the efficiency of obtaining an inductance.

As illustrated in FIG. 1 and FIG. 2, the coil 30 includes a first wire 31, a second wire 32, a third wire 33, and a fourth wire 34. The first wire 31 and the second wire 32 are wound around the winding core portion 11 of the core 10. In the present embodiment, the third wire 33 and the fourth wire 34 are wound around an outer side portion of portions of the first wire 31 and the second wire 32 wound around the winding core portion 11. A direction in which the third wire 33 and the fourth wire 34 are wound is opposite to a direction in which the first wire 31 and the second wire 32 are wound.

The coil 30 has a winding portion 30*a* wound around the winding core portion 11, and connection portions 30*b* and 30*c* on both sides of the winding portion 30*a* in the length direction Ld. The winding portion 30*a* is a portion in which each of the wires 31 to 34 is wound around the winding core portion 11. The third wire 33 and the fourth wire 34 configuring the winding portion 30*a* are portions which are wound around the winding core portion 11 or the first wire 31 and the second wire 32. The connection portions 30*b* and 30*c* include end portions and vicinities thereof which are connected to the terminal electrodes 21 to 24 of the first flange portion 12 and the terminal electrodes 25 to 28 of the second flange portion 13, respectively, in the wires 31 to 34. In addition, in the winding portion 30*a*, the number of windings (number of turns) of the first wire 31 and the second wire 32 is equal to the number of windings (number of turns) of the third wire 33 and the fourth wire 34.

Figure 5:
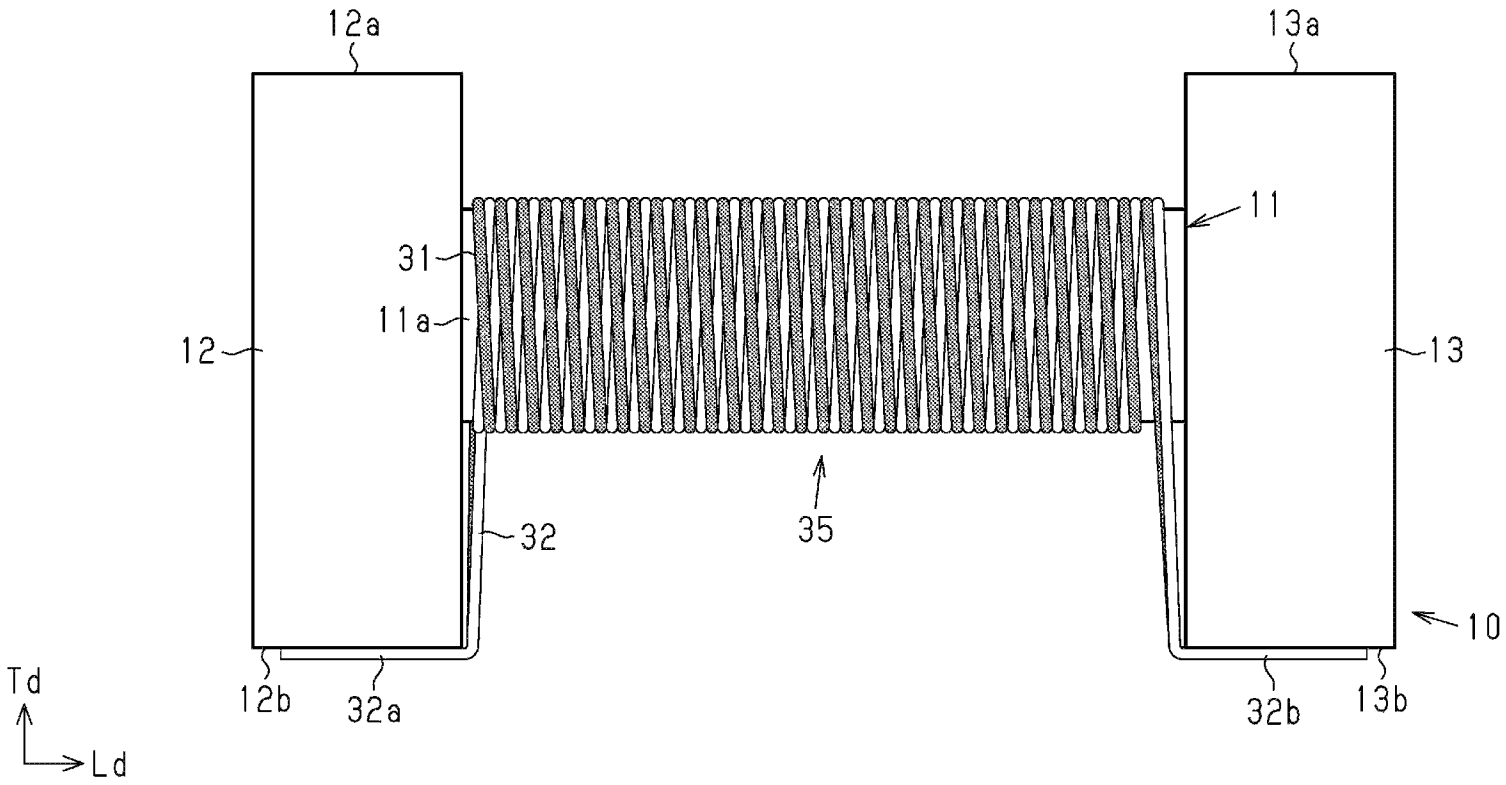
FIG. 5 is a schematic side view illustrating a state in which a first wire and a second wire are wound around the winding core portion.
Figure 6:
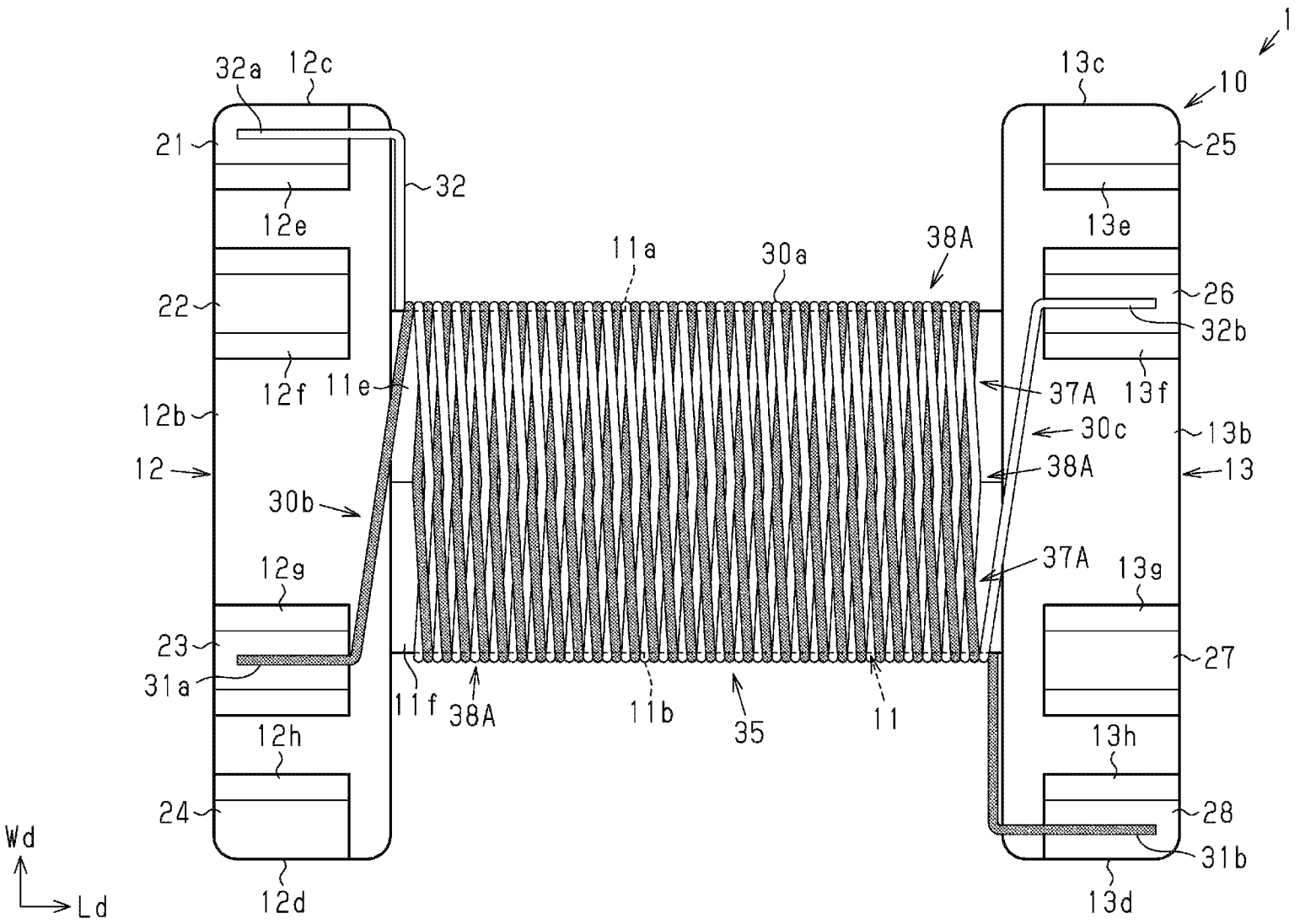
FIG. 6 is a schematic bottom view illustrating a state in which the first wire and the second wire are wound around the winding core portion.

As illustrated in FIG. 5 and FIG. 6, a portion of the first wire 31 and the second wire 32 wound around the winding core portion 11 has, at least in part, a first twisted wire portion 35 twisted each other. In the present embodiment, all of the portions of the first wire 31 and the second wire 32 wound around the winding core portion 11 form the first twisted wire portion 35. The first wire 31 and the second wire 32 are spirally wound around the winding core portion 11 in a twisted wire state of being twisted each other by substantially the same number of windings (number of turns). Note that a range in which the first twisted wire portion 35 is formed is not limited to all portions in which the first wire 31 and the second wire 32 are wound around the winding core portion 11, and can be arbitrarily changed. In one example, a part of the first wire 31 and the second wire 32 wound around the winding core portion 11 may be a bifilar-winding. In short, the first twisted wire portion 35 may be formed by at least a part of portions of the first wire 31 and the second wire 32 wound around the winding core portion 11.

Figure 8A:
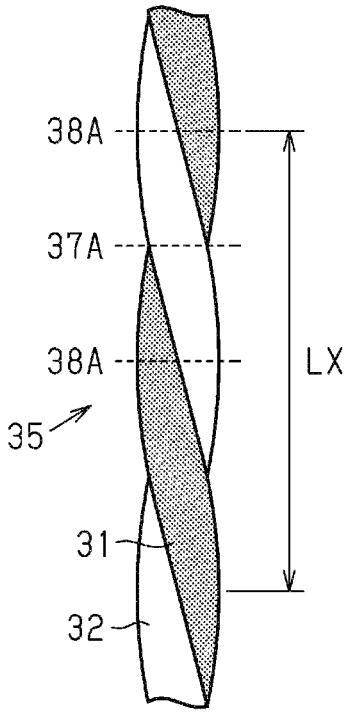
FIG. 8A and FIG. 8B are explanatory views illustrating a twisted wire state of the first wire and the second wire.
Figure 8B:
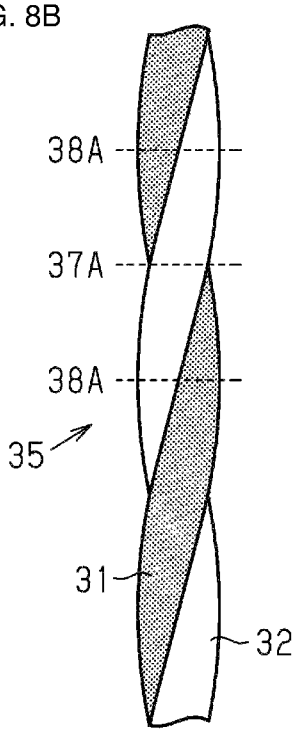

FIG. 8A and FIG. 8B illustrate the first twisted wire portion 35. In FIGS. 8A and 8B, the first wire 31 is hatched, the second wire 32 is illustrated in white, which makes the twisted wire state of the first wire 31 and the second wire 32 be easy to understand.

FIG. 8A illustrates a configuration in which the twisted wire state of the first twisted wire portion 35 is an S twist, and FIG. 8B illustrates a configuration in which the twisted wire state of the first twisted wire portion 35 is a Z twist. The Z twist and the S twist are oriented in mutually opposite twist directions between the first wire 31 and the second wire 32. In the present embodiment, the twisted wire state of the first twisted wire portion 35 is the S twist. Note that the twisted wire state of the first twisted wire portion 35 may be the Z twist.

In FIGS. 8A and 8B, it is intended that a peripheral surface configuring the surface of the winding core portion 11 is present on the other side of the paper surface. As illustrated in FIG. 8A, in the twisted wire state of the first twisted wire portion 35 viewed from a direction perpendicular to the peripheral surface of the winding core portion 11, a twist of about 360 degrees is applied to the first wire 31 and the second wire 32 in a range of a length LX. In other words, the number of twists of the first wire 31 and the second wire 32 is "1" in the range of the length LX. In this case, the length LX is referred to as a twist pitch of the first twisted wire portion 35.

In addition, when viewed from a direction perpendicular to the peripheral surface of the winding core portion 11, a portion in a state in which the first wire 31 and the second wire 32 overlap each other is referred to as a node portion 37A of the first twisted wire portion 35. The node portion 37A is a portion in a state in which the first wire 31 and the second wire 32 are arranged side by side in a direction perpendicular to the peripheral surface of the winding core portion 11. When viewed from a direction perpendicular to the peripheral surface of the winding core portion 11, a portion in a state in which the first wire 31 and the second wire 32 are arranged side by side is referred to as a belly portion 38A of the first twisted wire portion 35. The belly portion 38A is a portion in which the first wire 31 and the second wire 32 overlap each other in a direction parallel to a surface direction of the peripheral surface of the winding core portion 11.

Figure 7:
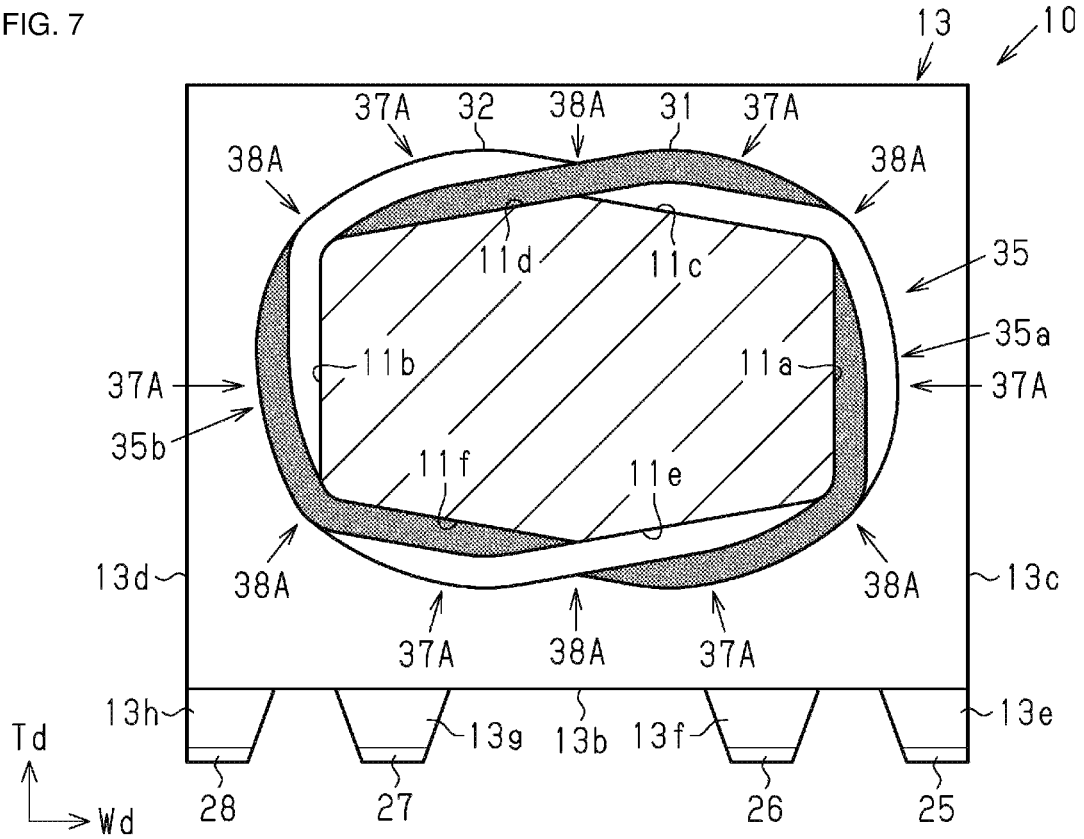
FIG. 7 is a schematic cross-sectional view illustrating one turn of the winding core portion and the coil.

FIG. 7 is a cross-sectional view taken along a plane orthogonal to the length direction Ld of the winding core portion 11 of the coil component 1, and illustrates a state in which the first wire 31 and the second wire 32 are wound around the winding core portion 11, and a state in which the third wire 33 and the fourth wire 34 are not wound. FIG. 7 illustrates a portion in which the first wire 31 and the second wire 32 are wound in one turn.

As illustrated in FIG. 7, the first twisted wire portion 35 of the present embodiment is configured such that one node portion 37A is arranged on each of the side surfaces 11*a* and 11*b*, the first surfaces 11*c* and 11*d*, and the second surfaces 11*e* and 11*f* which configure the peripheral surface of the winding core portion 11, in one turn. Further the first twisted wire portion 35 is configured such that the belly portion 38A is arranged at a ridge portion between each of the side surfaces 11*a* and 11*b*, the first surfaces 11*c* and 11*d*, and the second surfaces 11*e* and 11*f* of the winding core portion 11, in one turn. In the belly portion 38A, the first wire 31 and the second wire 32 are both in contact with the winding core portion 11 with respect to each of the peripheral surfaces of the winding core portion 11. Therefore, the first wire 31 and the second wire 32 are stably wound around the winding core portion 11, so that a winding collapse does not occur.

In a cross section taken along a plane orthogonal to the length direction Ld of the winding core portion 11, the length of each side configuring the cross section of the winding core portion 11 is equal to each other. Since the node portion 37A of the first twisted wire portion 35 is arranged on the side surfaces 11*a* and 11*b*, the first surfaces 11*c* and 11*d*, and the second surfaces 11*e* and 11*f* of the winding core portion 11, a distance (pitch) between the node portions adjacent to each other 37A in a winding direction of the coil 30 is the same in one turn of the coil 30.

As illustrated in FIG. 5, in the side surface 11*a* of the winding core portion 11 of the present embodiment, the node portions 37A adjacent to each other of the first twisted wire portion 35 in the length direction Ld are arranged along the length direction Ld. As illustrated in FIG. 6, on each of the second surfaces 11*e* and 11*f* of the winding core portion 11, the node portions 37A adjacent to each other in the length direction Ld of the first twisted wire portion 35 are arranged along the length direction Ld. Although not illustrated in the figure, similarly, also on the first surfaces 11*c* and 11*d* and the side surface 11*b*, the node portions 37A adjacent to each other of the first twisted wire portion 35 in the length direction Ld are arranged along the length direction Ld.

As illustrated in FIG. 7, in the present embodiment, a first side surface portion 35*a* formed on the side surface 11*a* of the winding core portion 11 in the first twisted wire portion 35 has the same shape as a second side surface portion 35*b* formed on the side surface 11*b* of the winding core portion 11. Here, the same shape means a case where the positional relationship between the node portion 37A and the belly portion 38A is the same regardless of the first wire 31 and the second wire 32. Even though the first wire 31 and the second wire 32 are replaced, an inclination of the first twisted wire portion 35 with respect to the core 10 may be different. At this time, the number of the node portions 37A and the belly portions 38A of the first side surface portion 35*a* is equal to the number of the node portions 37A and the belly portions 38A of the second side surface portion 35*b*. The first side surface portion 35*a* of the present embodiment includes one node portion 37A, and the second side surface portion 35*b* includes one node portion 37A. The belly portions 38A on both sides of the node portion 37A in a direction in which the first twisted wire portion 35 extends are arranged on the ridge portions between the side surface 11*a* and the first surface 11*c* and between the side surface 11*a* and the second surface 11*e* of the winding core portion 11. The belly portions 38A on both sides of the node portion 37A in the direction in which the first twisted wire portion 35 extends are arranged on the ridge portions between the side surface 11*b* and the first surface 11*d* and between the side surface 11*b* and the second surface 11*f* of the winding core portion 11.

The first wire 31 has one end portion 31*a* and another end portion 31*b*. The one end portion 31*a* of the first wire 31 is included in the connection portion 30*b*, and the other end portion 31*b* is included in the connection portion 30*c*. In the present embodiment, the one end portion 31*a* of the first wire 31 configures an end portion of a winding start of the first wire 31, and the other end portion 31*b* of the first wire 31 configures an end portion of a winding end of the first wire 31. The one end portion 31*a* of the first wire 31 is connected to the third terminal electrode 23 of the first flange portion 12. The other end portion 31*b* of the first wire 31 is connected to the eighth terminal electrode 28 of the second flange portion 13.

The second wire 32 has one end portion 32*a* and another end portion 32*b*. The one end portion 32*a* of the second wire 32 is included in the connection portion 30*b*, and the other end portion 32*b* is included in the connection portion 30*c*. In the present embodiment, the one end portion 32*a* of the second wire 32 configures an end portion of a winding start of the second wire 32, and the other end portion 32*b* of the second wire 32 configures an end portion of a winding end of the second wire 32. The one end portion 32*a* of the second wire 32 is connected to the first terminal electrode 21 of the first flange portion 12. The other end portion 32*b* of the second wire 32 is connected to the sixth terminal electrode 26 of the second flange portion 13.

The first wire 31 and the second wire 32 are connected to the first terminal electrode 21, the third terminal electrode 23, the fifth terminal electrode 25, and the eighth terminal electrode 28 by, for example, thermal pressure bonding, brazing, welding, or the like.

A portion of the third wire 33 and the fourth wire 34 wound around an outer side portion of portions of the first wire 31 and the second wire 32 wound around the winding core portion 11 has, at least in part, a second twisted wire portion 36 twisted each other. In the present embodiment, all of the portions of the third wire 33 and the fourth wire 34 wound around the outer side portion of the portions of the first wire 31 and the second wire 32 wound around the winding core portion 11 form the second twisted wire portion 36. The third wire 33 and the fourth wire 34 are spirally wound around the winding core portion 11 in a twisted wire state of being twisted each other by substantially the same number of windings (number of turns). In the present embodiment, the twisted wire state of the second twisted wire portion 36 is the Z twist. Note that the twisted wire state of the second twisted wire portion 36 may be the S twist. Further, a range in which the second twisted wire portion 36 is formed is not limited to all portions of the portions in which the first wire 31 and the second wire 32 are wound around the winding core portion 11, and can be arbitrarily changed. In one example, a part of the third wire 33 and the fourth wire 34 wound around the outer side portion of the portions of the first wire 31 and the second wire 32 wound around the winding core portion 11 may be a bifilar-winding. In short, the second twisted wire portion 36 may be formed by at least a part of the portions of the third wire 33 and the fourth wire 34 wound around the outer side portion of the portions of the first wire 31 and the second wire 32 wound around the winding core portion 11.

Figure 9A:
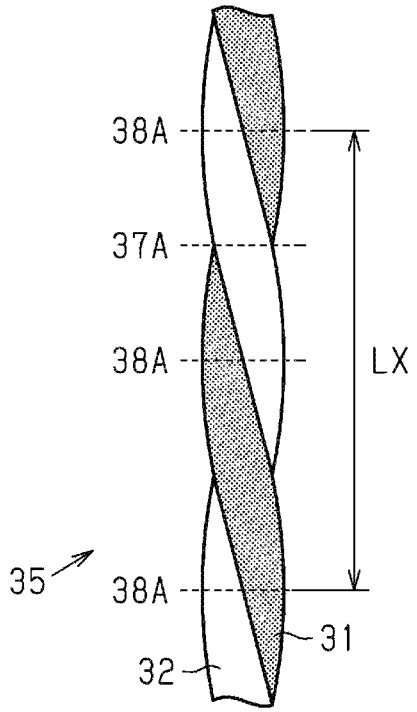
FIG. 9A is an explanatory view illustrating a twisted wire state of the first wire and the second wire.
Figure 9B:
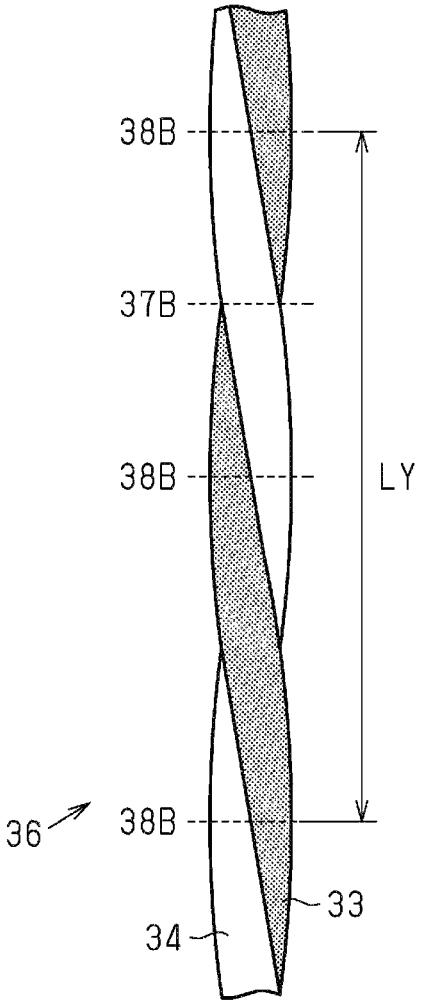
FIG. 9B is an explanatory view illustrating a twisted wire state of a third wire and a fourth wire.

In FIG. 9B, it is intended that a peripheral surface configuring the surface of the winding core portion 11 is present on the other side of the paper surface. In FIG. 9B, the third wire 33 is hatched, and the fourth wire 34 is illustrated in white, which makes the twisted wire state of the third wire 33 and the fourth wire 34 be easy to understand. As illustrated in FIG. 9B, in the twisted wire state of the second twisted wire portion 36 viewed from a direction perpendicular to each of the peripheral surfaces of the winding core portion 11, a twist of 360 degrees is applied to the third wire 33 and the fourth wire 34 in a range of a length LY. In other words, the number of twists of the third wire 33 and the fourth wire 34 is "1" in the range of the length LY. In this case, the length LY is referred to as a twist pitch of the second twisted wire portion 36.

In addition, when viewed from a direction perpendicular to the peripheral surface of the winding core portion 11, a portion in which the third wire 33 and the fourth wire 34 overlap each other is referred to as a node portion 37B of the second twisted wire portion 36. The node portion 37B is a portion in which the third wire 33 and the fourth wire 34 are arranged side by side in a direction perpendicular to the peripheral surface of the winding core portion 11. When viewed from a direction perpendicular to the peripheral surface of the winding core portion 11, a portion in a state in which the third wire 33 and the fourth wire 34 are arranged side by side is referred to as a belly portion 38B. The belly portion 38B is a portion in which the third wire 33 and the fourth wire 34 overlap each other in a direction parallel to the surface direction of the peripheral surface of the winding core portion 11.

The total number of twists of the first wire 31 and the second wire 32 (the total number of twists of the first twisted wire portion 35) is larger than the total number of twists of the third wire 33 and the fourth wire 34 (the total number of twists of the second twisted wire portion 36). As a result, a length of a portion of the first wire 31 and the second wire 32 wound around the winding core portion 11 such that the first wire 31 and the second wire 32 are adjacent to each other is configured to be equal to a length of a portion of the third wire 33 and the fourth wire 34 wound around the outer side portion of the portion of the first wire 31 and the second wire 32 wound around the winding core portion 11 such that the third wire 33 and the fourth wire 34 are adjacent to each other. Here, the fact that the first wire 31 and the second wire 32 are adjacent to each other includes a state in which the first wire 31 and the second wire 32 are adjacent to each other in a contact state, and a state in which the first wire 31 and the second wire 32 are adjacent to each other in a state in which a slight gap is formed. Further, the fact that the third wire 33 and the fourth wire 34 adjacent to each other includes a state in which the third wire 33 and the fourth wire 34 are adjacent to each other, and a state in which the third wire 33 and the fourth wire 34 are slightly spaced apart from and adjacent to each other.

A portion in which the first twisted wire portion 35 is formed and the first wire 31 and the second wire 32 are adjacent to each other in a contact state includes the node portion 37A. In a case where a portion of the winding portion 30*a* in which the first wire 31 and the second wire 32 are bifilar-wound is present, a portion in which the first wire 31 and the second wire 32 are adjacent to each other in a contact state is a portion in which the first wire 31 and the second wire 32 are in contact with each other in the length direction Ld.

The fact that the state in which the first wire 31 and the second wire 32 are adjacent to each other in a state in which a slight gap is formed includes a state in which the first wire 31 and the second wire 32 are not in contact with each other. A portion in which the first twisted wire portion 35 is formed and the first wire 31 and the second wire 32 are adjacent to each other in a state in which a slight gap is formed includes the belly portion 38A. In the case where the portion of the winding portion 30*a* in which the first wire 31 and the second wire 32 are bifilar-wound is present, the portion in which the first wire 31 and the second wire 32 are adjacent to each other in a state in which a slight gap is formed is, for example, a portion in which the first wire 31 and the second wire 32 are adjacent to each other in a state in which a gap having a distance equal to or smaller than a wire diameter is formed in the length direction Ld. The wire diameter is a diameter of each of the wires 31 to 34.

A portion in which the second twisted wire portion 36 is formed and the third wire 33 and the fourth wire 34 are adjacent to each other in a contact state includes the node portion 37B. In a case where a portion of the winding portion 30*a* in which the third wire 33 and the fourth wire 34 are bifilar-wound is present, a portion in which the third wire 33 and the fourth wire 34 are adjacent to each other in a contact state is a portion in which the third wire 33 and the fourth wire 34 are in contact with each other in the length direction Ld.

The fact that a state in which the third wire 33 and the fourth wire 34 are adjacent to each other in a state in which a slight gap is formed includes a state in which the third wire 33 and the fourth wire 34 are not in contact with each other. A portion in which the second twisted wire portion 36 is formed and the third wire 33 and the fourth wire 34 are adjacent to each other in a state in which a slight gap is formed includes the belly portion 38B. In a case where a portion of the winding portion 30*a* in which the third wire 33 and the fourth wire 34 are bifilar-wound is present, a portion in which the third wire 33 and the fourth wire 34 are adjacent to each other in a state in which a slight gap is formed is, for example, a portion in which the third wire 33 and the fourth wire 34 are adjacent to each other in a state in which a gap having a distance equal to or smaller than the wire diameter is formed in the length direction Ld.

In the present embodiment, as illustrated in FIG. 9A and FIG. 9B, the twist pitch (length LX) of the first twisted wire portion 35 is smaller than the twist pitch (length LY) of the second twisted wire portion 36. Here, the fact that the length of the portion of the first wire 31 and the second wire 32 wound around the winding core portion 11 such that the first wire 31 and the second wire 32 are adjacent to each other is equal to the length of the portion of the third wire 33 and the fourth wire 34 wound around the outer side portion of the portion of the first wire 31 and the second wire 32 wound around the winding core portion 11 such that the third wire 33 and the fourth wire 34 are adjacent to each other includes an error of within about 3% of the length of the portion of the first wire 31 and the second wire 32 wound around the winding core portion 11 such that the first wire 31 and the second wire 32 are adjacent to each other, or the length of the portion of the third wire 33 and the fourth wire 34 wound around the outer side portion of the portion of the first wire 31 and the second wire 32 wound around the winding core portion 11 such that the third wire 33 and the fourth wire 34 are adjacent to each other.

In the present embodiment, as illustrated in FIG. 5 and FIG. 6, in all of the portions of the first wire 31 and the second wire 32 wound around the winding core portion 11, the first wire 31 and the second wire 32 are adjacent to each other. Therefore, the length of the portion of the first wire 31 and the second wire 32 wound around the winding core portion 11 such that the first wire 31 and the second wire 32 are adjacent to each other is substantially equal to the length of the portion of the first wire 31 and the second wire 32 wound around the winding core portion 11. In the present embodiment, as illustrated in FIG. 1 and FIG. 2, the third wire 33 and the fourth wire 34 are adjacent to each other in all of the portions of the third wire 33 and the fourth wire 34 wound around the outer side portion of the portion of the first wire 31 and the second wire 32 wound around the winding core portion 11. For this reason, the length of the portion of the third wire 33 and the fourth wire 34 wound around the outer side portion of the portion of the first wire 31 and the second wire 32 wound around the winding core portion 11 such that the third wire 33 and the fourth wire 34 are adjacent to each other is substantially equal to the length of the portion of the third wire 33 and the fourth wire 34 wound around the outer side portion of the portion of the first wire 31 and the second wire 32 wound around the winding core portion 11.

In the second twisted wire portion 36 of the present embodiment, one node portion 37B is arranged on the first surfaces 11*c* and 11*d* of the winding core portion 11, and one node portion 37B is arranged on the second surfaces 11*e* and 11*f*. In the second twisted wire portion 36, one node portion 37B is arranged on the side surface 11*a* of the winding core portion 11, and one node portion 37B is arranged on the side surface 11*b*.

In the first surfaces 11*c* and 11*d* of the winding core portion 11 of the present embodiment, the node portions 37B adjacent to each other of the second twisted wire portion 36 in the length direction Ld are arranged along the length direction Ld. In the present embodiment, the node portion 37B of the second twisted wire portion 36 on the first surfaces 11*c* and 11*d* of the winding core portion 11 is positioned on the belly portion 38A of the first twisted wire portion 35. In addition, in the side surface 11*a* of the winding core portion 11, the node portions 37B adjacent to each other of the second twisted wire portion 36 in the length direction Ld are arranged along the length direction Ld. The node portion 37B of the second twisted wire portion 36 on the side surface 11*a* of the winding core portion 11 is positioned on the node portion 37A of the first twisted wire portion 35. Although not illustrated in the figure, in the same way for the second surfaces 11*e*, 11*f* and the side surface 11*b*, the node portions 37B adjacent to each other of the second twisted wire portion 36 in the length direction Ld are arranged along the length direction Ld. In the present embodiment, the node portion 37B of the second twisted wire portion 36 on the second surfaces 11*e* and 11*f* of the winding core portion 11 is positioned on the belly portion 38A of the first twisted wire portion 35. The node portion 37B of the second twisted wire portion 36 on the side surface 11*b* of the winding core portion 11 is positioned on the node portion 37A of the first twisted wire portion 35.

The third wire 33 has one end portion 33*a* and another end portion 33*b*. The one end portion 33*a* of the third wire 33 is included in the connection portion 30*b*, and the other end portion 33*b* is included in the connection portion 30*c*. In the present embodiment, the one end portion 33*a* of the third wire 33 configures an end portion of a winding start of the third wire 33, and the other end portion 33*b* of the third wire 33 configures an end portion of a winding end of the third wire 33. The one end portion 33*a* of the third wire 33 is connected to the seventh terminal electrode 27 of the second flange portion 13. The other end portion 33*b* of the third wire 33 is connected to the fourth terminal electrode 24 of the first flange portion 12.

The fourth wire 34 has one end portion 34*a* and another end portion 34*b*. The one end portion 34*a* of the fourth wire 34 is included in the connection portion 30*b*, and the other end portion 34*b* is included in the connection portion 30*c*. In the present embodiment, the one end portion 34*a* of the fourth wire 34 configures an end portion of a winding start of the fourth wire 34, and the other end portion 34*b* of the fourth wire 34 configures an end portion of a winding end of the fourth wire 34. The one end portion 34*a* of the fourth wire 34 is connected to the fifth terminal electrode 25 of the second flange portion 13. The other end portion 34*b* of the fourth wire 34 is connected to the second terminal electrode 22 of the first flange portion 12.

The third wire 33 and the fourth wire 34 are connected to the second terminal electrode 22, the fourth terminal electrode 24, the fifth terminal electrode 25, and the seventh terminal electrode 27 by, for example, thermal pressure bonding, brazing, welding, or the like.

Each of the wires 31 to 34 is composed of a conductor wire of good conductor such as copper (Cu), silver (Ag), gold (Au), or the like and insulating coatings such as polyurethane, polyamide-imide, fluorine base resin, or the like, which cover the conductor wire. Therefore, in the portions of the first wire 31 and the second wire 32 wound around the winding core portion 11, the first wire 31 and the second wire 32 are electrically insulated from each other. In the portions of the third wire 33 and the fourth wire 34 wound around the outer side portion of the first wire 31 and the second wire 32, the third wire 33 and the fourth wire 34 are electrically insulated from each other.

When the coil component 1 is mounted in or on a circuit substrate PX, each of the terminal electrodes 21 to 28 faces a main surface of the circuit substrate PX. At this time, the winding core portion 11 is parallel to the main surface of the circuit substrate PX. That is, the coil 30 of the present embodiment is a coil having a horizontal winding structure (horizontal type) in which winding axes of the first wire 31, the second wire 32, the third wire 33, and the fourth wire 34 are parallel to the main surface of the circuit substrate PX.

Figure 10:
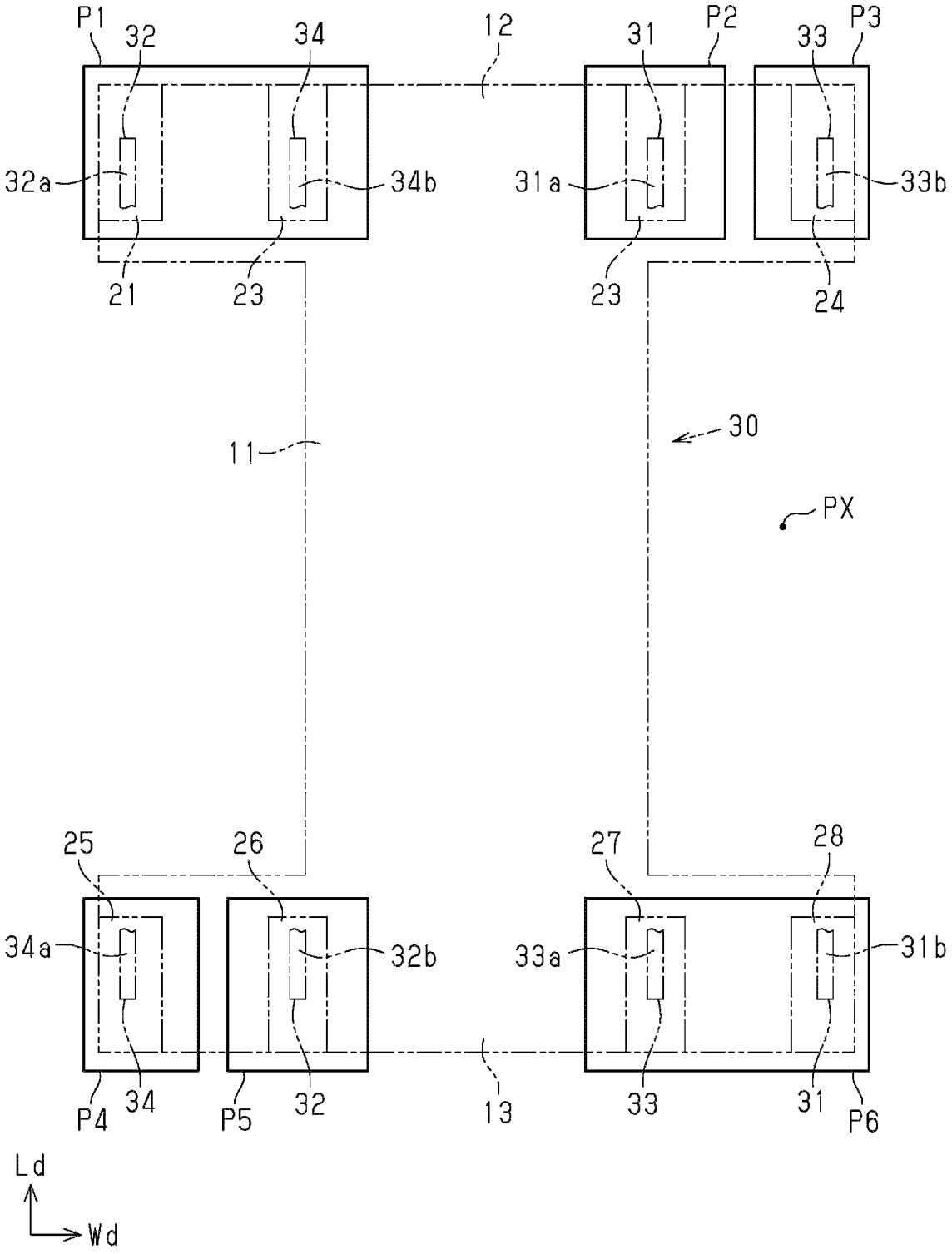
FIG. 10 is a schematic plan view illustrating a wiring pattern of a circuit substrate in or on which the coil component is mounted.

As illustrated in FIG. 10, the circuit substrate PX includes a first wiring pattern P1, a second wiring pattern P2, a third wiring pattern P3, a fourth wiring pattern P4, a fifth wiring pattern P5, and a sixth wiring pattern P6. The first wiring pattern P1, the second wiring pattern P2, and the third wiring pattern P3 are arranged at the same position in the length direction Ld and are spaced apart from each other in a width direction Wd. The fourth wiring pattern P4, the fifth wiring pattern P5, and the sixth wiring pattern P6 are arranged at the same position in the length direction Ld and are spaced apart from one another in the width direction Wd. The first wiring pattern P1, the second wiring pattern P2, and the third wiring pattern P3 are arranged to be spaced apart from the fourth wiring pattern P4, the fifth wiring pattern P5, and the sixth wiring pattern P6 in the length direction Ld. A dimension in the width direction Wd of the first wiring pattern P1 is larger than a dimension in the width direction Wd of each of the second wiring pattern P2 and the third wiring pattern P3. A dimension in the width direction Wd of the sixth wiring pattern P6 is larger than a dimension in the width direction Wd of each of the fourth wiring pattern P4 and the fifth wiring pattern P5.

When the coil component 1 of the present embodiment is mounted in or on the circuit substrate PX, the other end portion 31*b* of the first wire 31 is electrically connected to the one end portion 33*a* of the third wire 33, and one end portion 32*a* of the second wire 32 and the other end portion 34*b* of the fourth wire 34 are electrically connected to each other. Specifically, as illustrated in FIG. 10, the first wiring pattern P1 of the circuit substrate PX electrically connects one end portion 32*a* (first terminal electrode 21) of the second wire 32 and the other end portion 34*b* (second terminal electrode 22) of the fourth wire 34. The sixth wiring pattern P6 of the circuit substrate PX electrically connects the other end portion 31*b* (eighth terminal electrode 28) of the first wire 31 and the one end portion 33*a* (seventh terminal electrode 27) of the third wire 33. Further, the second wiring pattern P2 of the circuit substrate PX is electrically connected to the one end portion 31*a* (third terminal electrode 23) of the first wire 31. The third wiring pattern P3 of the circuit substrate PX is electrically connected to the other end portion 33*b* (fourth terminal electrode 24) of the third wire 33. The fourth wiring pattern P4 of the circuit substrate PX is electrically connected to the one end portion 34*a* (fifth terminal electrode 25) of the fourth wire 34. The fifth wiring pattern P5 of the circuit substrate PX is electrically connected to the other end portion 32*b* (sixth terminal electrode 26) of the second wire 32.

Figure 11:
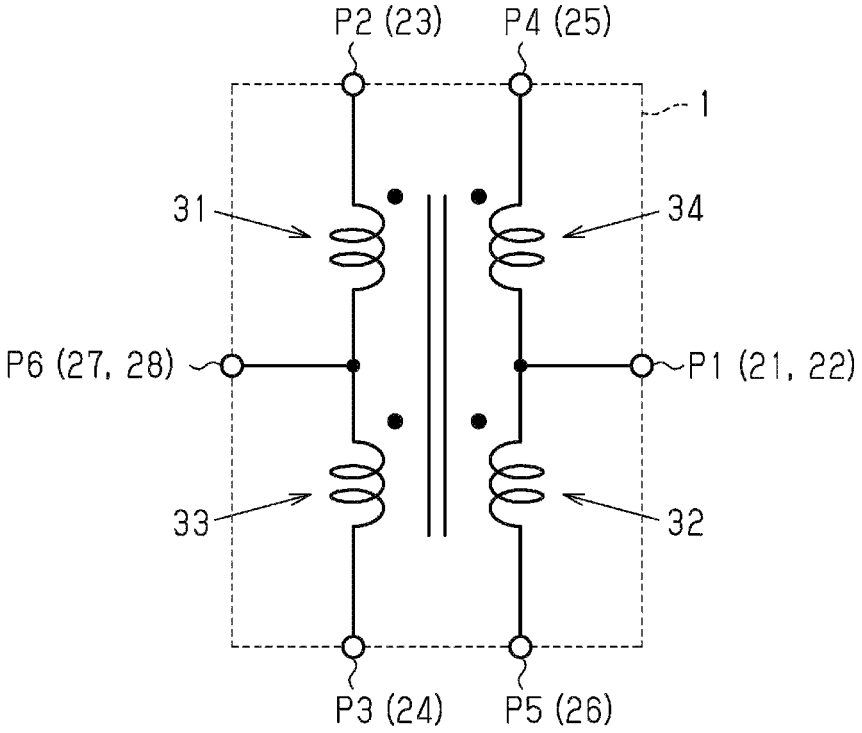
FIG. 11 is an explanatory diagram illustrating a circuit configuration of a coil component according to an embodiment.

In this manner, in the present embodiment, the coil component 1 is mounted in or on the circuit substrate PX, thereby configuring an equivalent circuit of the coil component 1 which is used as a signal transformer as illustrated in FIG. 11.

The third terminal electrode 23 of the first flange portion 12 configures an input plus side terminal of a balanced circuit, and the fourth terminal electrode 24 configures an input minus side terminal of the balanced circuit. The fifth terminal electrode 25 configures an output plus side terminal of the balanced circuit, and the sixth terminal electrode 26 configures an output minus side terminal of the balanced circuit. The first wire 31 and the third wire 33 configure a primary side winding of the signal transformer, and the second wire 32 and the fourth wire 34 configure a secondary side winding of the signal transformer. A first center tap is configured by the seventh terminal electrode 27 and the eighth terminal electrode 28, and a second center tap is configured by the first terminal electrode 21 and the second terminal electrode 22.

Next, a winding method of each of the wires 31 to 34 will be described.

Figure 12:
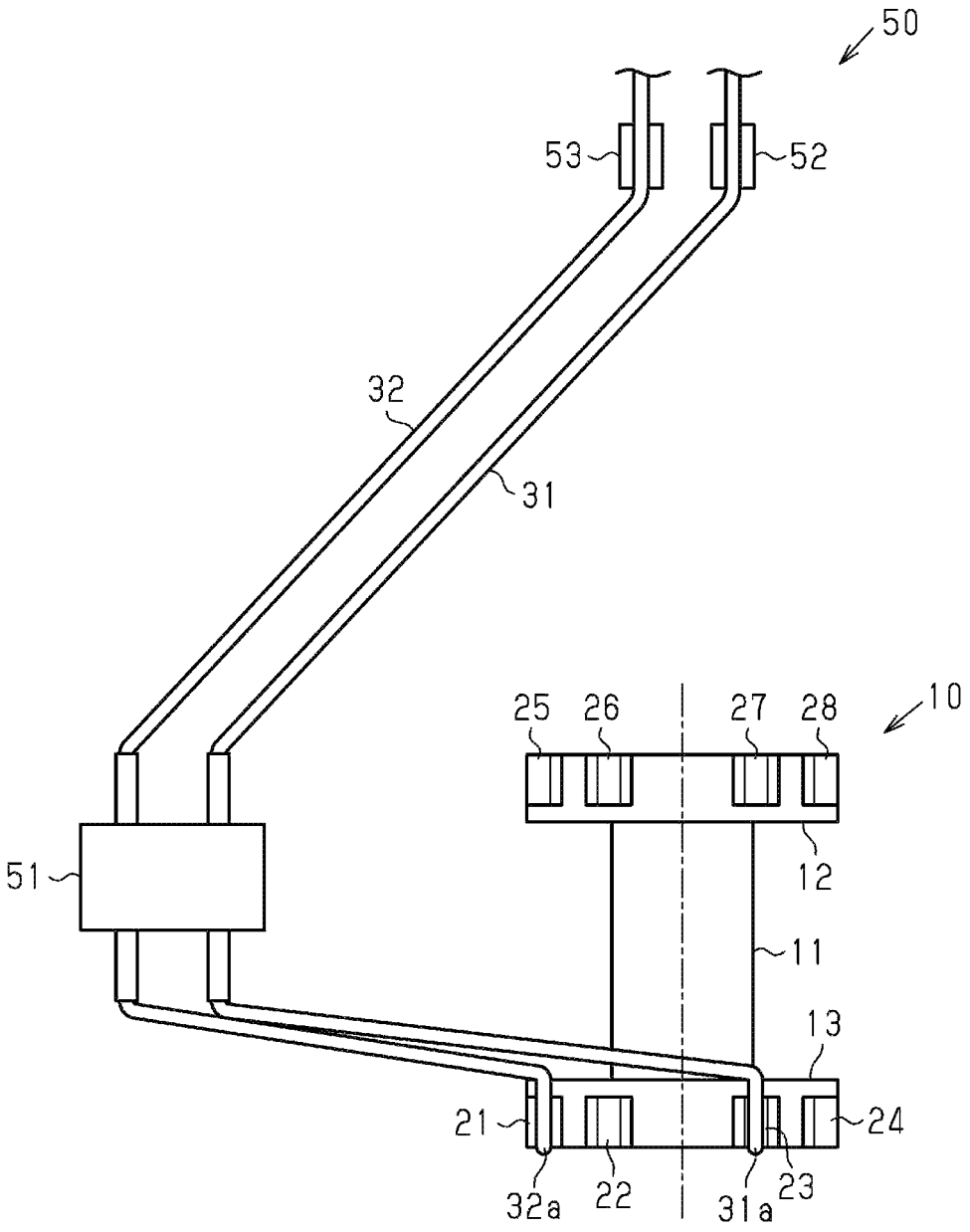
FIG. 12 is an explanatory view of a main part of a winding device for winding a wire on the core.

FIG. 12 illustrates a main portion of a winding device 50 for winding the first wire 31 and the second wire 32 around the core 10.

First, the first wire 31 and the second wire 32 are passed through tensioners 52 and 53 and a nozzle 51 in order, and tip ends of the first wire 31 and the second wire 32 are connected to the core 10. The first wire 31 and the second wire 32 are drawn out from a coil bobbin (not illustrated). The tensioner 52 applies tension to the first wire 31, and the tensioner 53 applies tension to the second wire 32.

Next, the winding device 50 revolves the nozzle 51 around the core 10 to wind the first wire 31 and the second wire 32 around the winding core portion 11 of the core 10 while twisting the first wire 31 and the second wire 32. As such, the first twisted wire portion 35 is formed. Depending on a revolution direction of the nozzle 51, the first wire 31 and the second wire 32 can be S-twisted as illustrated in FIG. 8A and Z-twisted as illustrated in FIG. 8B.

Then, the winding device 50 rotates the core 10 in the same direction as the revolution direction of the nozzle 51 while revolving the nozzle 51 around the core 10. When the winding device 50 does not rotate the core 10, the first wire 31 and the second wire 32 form, for which the number of twists is "1", that is, two node portions 37A, and are wound around the winding core portion 11 of the core 10 by the revolution of the nozzle 51. Therefore, the winding device 50 adjusts a revolution speed of the nozzle 51 and a rotation speed of the core 10, whereby it is possible to set the number of twists and the twist pitch per unit turn of the first wire 31 and the second wire 32, respectively.

Similarly, the third wire 33 and the fourth wire 34 are wound around the outer side portion of the portion of the first wire 31 and the second wire 32 wound around the winding core portion 11, by the winding device 50.

The winding device 50 revolves the nozzle 51 around the core 10 around which the first wire 31 and the second wire 32 are wound, and winds the third wire 33 and the fourth wire 34 on the portion of the first wire 31 and the second wire 32 wound around the winding core portion 11 while twisting the third wire 33 and the fourth wire 34. As such, the second twisted wire portion 36 is formed. In the present embodiment, the revolution direction of the nozzle 51 when the third wire 33 and the fourth wire 34 are wound around the outer side portion of the portion of the first wire 31 and the second wire 32 wound around the winding core portion 11 is opposite to the revolution direction of the nozzle 51 when the first wire 31 and the second wire 32 are wound around the winding core portion 11. The third wire 33 and the fourth wire 34 can be S-twisted and Z-twisted depending on the revolution direction of the nozzle 51.

Then, the winding device 50 rotates the core 10 in the same direction as the revolution direction of the nozzle while revolving the nozzle 51 around the core 10. In other words, the rotation direction of the core 10 when the third wire 33 and the fourth wire 34 are wound around the outer side portion of the portion of the first wire 31 and the second wire 32 wound around the winding core portion 11 is opposite to the rotation direction of the core 10 when the first wire 31 and the second wire 32 are wound around the winding core portion 11. The winding device 50 adjusts the revolution speed of the nozzle 51 and the rotation speed of the core 10, whereby it is possible to set each of the number of twists and the twist pitch per unit turn of the third wire 33 and the fourth wire 34.

In the present embodiment, the revolution speed of the nozzle 51 and the rotation speed of the core 10 are adjusted such that the total number of twists (the total number of twists of the first twisted wire portion 35) of the first wire 31 and the second wire 32 is larger than the total number of twists (the total number of twists of the second twisted wire portion 36) of the third wire 33 and the fourth wire 34.

The operation of the present embodiment will be described.

As a result of studying an insertion loss of the coil component, the inventor of the present application has found that when the coil is configured using two sets of two wires of a primary side wire and a secondary side wire, the insertion loss of the coil component increases according as increase of a difference of a stray capacitance between a specific primary side wire and secondary side wire from a stray capacitance between a remaining primary side wire and secondary side wire. Further, the inventor of the present application has found that the insertion loss increases according as increase of a difference between a length (hereinafter referred to as a "first length") of the portion of the first wire 31 and the second wire 32 wound around the winding core portion 11 such that the first wire 31 and the second wire 32 are adjacent to each other and a length (hereinafter referred to as a "second length") of the portion of the third wire 33 and the fourth wire 34 wound around the outer side portion of the first wire 31 and the second wire 32 such that the third wire 33 and the fourth wire 34 are adjacent to each other.

For example, assuming that the coil is configured by the bifilar-winding, since the third wire and the fourth wire are wound around the outer side portion of the first wire and the second wire, a length of one turn where the third wire and the fourth wire are wound so as to be adjacent to each other is longer than a length of one turn in which the first wire and the second wire are wound around the winding core portion 11 so as to be adjacent to each other. Therefore, in order to make the first length and the second length equal to each other, it is necessary to make the number of turns (hereinafter referred to as "number of second turns") of the portion of the third wire and the fourth wire wound around the outer side portion of the portion of the first wire and the second wire wound around the winding core portion 11 such that the third wire and the fourth wire are adjacent to each other be smaller than the number of turns (hereinafter referred to as "number of first turns") of the portion of the first wire and the second wire wound around the winding core portion 11 such that the first wire and the second wire are adjacent to each other. However, when the number of second turns is made to be smaller than the number of first turns, a potential difference is generated in two center taps of the coil component, so that ability to suppress noise in the coil component is reduced.

In view of such a situation, the inventor of the present application has adopted a configuration in which the first wire 31 and the second wire 32 form the first twisted wire portion 35, and the third wire 33 and the fourth wire 34 form the second twisted wire portion 36, as a countermeasure for reducing the insertion loss. More specifically, by the first twisted wire portion 35 and the second twisted wire portion 36, a configuration is adopted in which a length of the portion of the first wire 31 and the second wire 32 wound around the winding core portion 11 of the core 10 such that the first wire 31 and the second wire 32 are adjacent to each other is equal to a length of the portion of the third wire 33 and the fourth wire 34 wound around the outer side portion of the first wire 31 and the second wire 32 wound around the winding core portion 11 such that the third wire 33 and the fourth wire 34 are adjacent to each other. More specifically, the inventor of the present application has adopted a configuration in which the total number of twists of the first twisted wire portion 35 is larger than the total number of twists of the second twisted wire portion 36. Thus, without changing the number of turns of the first wire 31 and the second wire 32 and the number of turns of the third wire 33 and the fourth wire 34, it is possible to adjust each of a length of the first wire 31 and a length of the second wire 32, which are wound around the winding core portion 11, and each of a length of the third wire 33 and a length of the fourth wire 34, which are wound around the outer side portion of the winding portion 11 of the first wire 31 and the second wire 32, depending on the number of twists. Therefore, since the number of first turns can be made equal to the number of second turns, the potential difference between two center taps can be brought to 0 or close to 0. Accordingly, when two center taps are connected to the ground, a common mode current flows to the ground, so that noise of the coil component 1 can be reduced. As a result, both the insertion loss and noise of the coil component 1 can be reduced.

Further, since the first wire 31 and the second wire 32 are twisted, impedance can be reduced even in a high frequency band compared to a case where the first wire 31 and the second wire 32 are bifilar-wound around the winding core portion 11, so that leakage inductances of the first wire 31 and the second wire 32 can be reduced. Similar to the first wire 31 and the second wire 32, in the third wire 33 and the fourth wire 34, the leakage inductance of the third wire 33 and the fourth wire 34 can be reduced compared to a case where the third wire 33 and the fourth wire 34 are bifilar-wound. As a result, the insertion loss of the coil component 1 can be further reduced.

The effects of the present embodiment will be described.

(1) By the first twisted wire portion 35, it is configured such that the length of the portion of the first wire 31 and the second wire 32 wound around the winding core portion 11 of the core 10 such that the first wire 31 and the second wire 32 are adjacent to each other is equal to the length of the portion of the third wire 33 and the fourth wire 34 wound around the outer side portion of the first wire 31 and the second wire 32 wound around the winding core portion 11 such that the third wire 33 and the fourth wire 34 are adjacent to each other. Thus, the difference of the stray capacitance between the first wire 31 and the second wire 32 from the stray capacitance between the third wire 33 and the fourth wire 34 becomes 0 or close to 0. In addition, the first wire 31 and the second wire 32 form the first twisted wire portion 35, so that the leakage inductance between the first wire 31 and the second wire 32 is reduced. As described above, the stray capacitance difference and the leakage inductance are reduced, so that insertion loss in the entire frequency band of the coil component 1 is reduced. Therefore, it is possible to enhance the versatility of the coil component 1 for the communication band.

(2) The portion of the third wire 33 and the fourth wire 34 wound around the outer side portion of the portion of the first wire 31 and the second wire 32 wound around the winding core portion 11 forms the second twisted wire portion 36 twisted each other. According to this configuration, the leakage inductance between the third wire 33 and the fourth wire 34 is reduced, so that the insertion loss of the coil component 1 can be further reduced.

(3) The total number of twists of the first twisted wire portion 35 is larger than the total number of twists of the second twisted wire portion 36. According to this configuration, without changing the number of turns of the first wire 31 and the second wire 32 and the number of turns of the third wire 33 and the fourth wire 34, it is possible to adjust the lengths of the first wire 31 and the second wire 32 wound around the winding core portion 11, and the lengths of the third wire 33 and the fourth wire 34 wound around the outer side portion of the portion of the first wire 31 and the second wire 32 wound around the winding core portion 11.

(4) The number of twists per predetermined length of the first twisted wire portion 35 is larger than the number of twists per predetermined length of the second twisted wire portion 36. In other words, the twist pitch of the first twisted wire portion 35 is shorter than the twist pitch of the second twisted wire portion 36. According to this configuration, without changing the number of turns of the first wire 31 and the second wire 32 and the number of turns of the third wire 33 and the fourth wire 34, it is possible to adjust the lengths of the first wire 31 and the second wire 32 wound around the winding core portion 11, and the lengths of the third wire 33 and the fourth wire 34 wound around the outer side portion of the portion of the first wire 31 and the second wire 32 wound around the winding core portion 11.

(5) When viewed from a direction orthogonal to the peripheral surface of the winding core portion 11 of the core 10, the belly portion 38A of the first wire 31 and the second wire 32 in the first twisted wire portion 35 is arranged at the corner portion (ridge portion) of the winding core portion 11. According to this configuration, it is possible to suppress winding collapse of the first wire 31 and the second wire 32.

(6) The node portion 37B of the third wire 33 and the fourth wire 34 is arranged on the belly portion 38A of the first wire 31 and the second wire 32. According to this configuration, compared to a case where the node portion 37A of the third wire 33 and the fourth wire 34 is arranged on the node portion 37A of the first wire 31 and the second wire 32, it is possible to suppress the size of the coil 30 from becoming larger.

(7) The distance between the second terminal electrode 22 and the third terminal electrode 23 in the width direction Wd is larger than each of the distance between the first terminal electrode 21 and the second terminal electrode 22 in the width direction Wd and the distance between the third terminal electrode 23 and the fourth terminal electrode 24 in the width direction Wd. The distance between the sixth terminal electrode 26 and the seventh terminal electrode 27 in the width direction Wd is larger than each of the distance between the fifth terminal electrode 25 and the sixth terminal electrode 26 in the width direction Wd and the distance between the seventh terminal electrode 27 and the eighth terminal electrode 28 in the width direction Wd. According to this configuration, a distance between the one end portion 32*a* of the second wire 32 and the other end portion 33*b* of the third wire 33 in the width direction Wd is increased, and a distance between the other end portion 31*b* of the first wire 31 and the one end portion 34*a* of the fourth wire 34 is increased, so that an insulation distance between the primary side winding and the secondary side winding of the coil component 1 can be secured.

Modification Example

The above embodiment is illustrative of a possible form of coil components for the present disclosure and is not intended to limit the form thereof. The coil components for the present disclosure may take a different form from the form illustrated in the above embodiment. One example is a configuration in which a part of the configuration of the above embodiment is replaced, changed or omitted, or a configuration in which a new configuration is added to the above embodiment. In the following modification examples, the same reference numerals as those in the above embodiment are assigned to portions common to the form in the above embodiment, and a description thereof will not be repeated.

In the above embodiment and the modification example, the number of the node portions 37A of the first twisted wire portion 35 can be arbitrarily changed.

For example, a plurality of node portions 37A of the first twisted wire portion 35 may be formed on the side surfaces 11*a* and 11*b* of the winding core portion 11 in one turn of the coil 30. In addition, for example, the number of the node portions 37A of the first twisted wire portion 35 on the side surface 11*a* of the winding core portion 11 may be different from the number of the node portions 37A on the side surface 11*b* in one turn of the coil 30. In addition, for example, the node portion 37A of the first twisted wire portion 35 may not be formed on at least one of the side surface 11*a* and the side surface 11*b* of the winding core portion 11 in one turn of the coil 30.

For example, one or three or more node portions 37A of the first twisted wire portion 35 may be formed on the first surfaces 11*c* and 11*d* of the winding core portion 11 in one turn of the coil 30. In addition, for example, one or three or more node portions 37A of the first twisted wire portion 35 may be formed on the second surfaces 11*e* and 11*f* of the winding core portion 11 in one turn of the coil 30. In addition, for example, the number of the node portions 37A of the first twisted wire portion 35 on the first surfaces 11*c* and 11*d* of the winding core portion 11 may be different from the number of the node portions 37A on the second surfaces 11*e* and 11*f* in one turn of the coil 30. In addition, for example, the node portion 37A of the first twisted wire portion 35 may not be formed on the first surfaces 11*c* and 11*d* of the winding core portion 11. In addition, for example, the node portion 37A of the first twisted wire portion 35 may not be formed on the second surfaces 11*e* and 11*f* of the winding core portion 11.

In the above embodiment and the modification example, formation positions of the node portions 37A of the first twisted wire portion 35 in the length direction of the first wire 31 and the second wire 32 are not limited to positions at equal intervals, and may be at unequal intervals.

In the above embodiment and the modification example, at least one of the node portions 37A of the first twisted wire portion 35 may be arranged at the ridge portion of the winding core portion 11.

In the above embodiment and the modification example, the number of the node portions 37B of the second twisted wire portion 36 can be arbitrarily changed.

For example, a plurality of node portions 37B of the second twisted wire portion 36 may be formed on the side surfaces 11*a* and 11*b* of the winding core portion 11 in one turn of the coil 30. In addition, for example, the number of the node portions 37B of the second twisted wire portion 36 corresponding to the side surface 11*a* of the winding core portion 11 may be different from the number of the node portions 37B corresponding to the side surface 11*b* in one turn of the coil 30. In addition, for example, the node portion 37B of the second twisted wire portion 36 corresponding to at least one of the side surface 11*a* and the side surface 11*b* of the winding core portion 11 may not be formed in one turn of the coil 30. In addition, for example, the number of the node portions 37B of the second twisted wire portion 36 corresponding to the side surfaces 11*a* and 11*b* of the winding core portion 11 in one turn of the coil 30 may be larger than the number of the node portions 37A of the first twisted wire portion 35 on the side surfaces 11*a* and 11*b* of the winding core portion 11. In this case, the number of twists of the second twisted wire portion 36 in another portion is adjusted in such a manner that the total number of twists of the second twisted wire portion 36 is smaller than the total number of twists of the first twisted wire portion 35.

For example, a plurality of node portions 37B of the second twisted wire portion 36 may be formed on the first surfaces 11*c* and 11*d* of the winding core portion 11 in one turn of the coil 30. In addition, for example, the number of the node portions 37B of the second twisted wire portion 36 corresponding to the first surfaces 11*c* and 11*d* of the winding core portion 11 in one turn of the coil 30 may be equal to the number of the belly portion 38B corresponding to the first surfaces 11*c* and 11*d*. In addition, for example, a plurality of node portions 37B of the second twisted wire portion 36 may be formed on the second surfaces 11*e* and 11*f* of the winding core portion 11 in one turn of the coil 30. In addition, for example, the number of the node portions 37B of the second twisted wire portion 36 corresponding to the first surfaces 11*c* and 11*d* of the winding core portion 11 in one turn of the coil 30 may be equal to the number of the node portions 37B corresponding to the second surfaces 11*e* and 11*f*. In addition, for example, the number of the node portions 37B of the second twisted wire portion 36 on the first surfaces 11*c* and 11*d* of the winding core portion 11 may be different from the number of the node portions 37B on the second surfaces 11*e* and 11*f* in one turn of the coil 30. In addition, for example, the node portion 37B of the second twisted wire portion 36 may not be formed on the first surfaces 11*c* and 11*d* of the winding core portion 11. In addition, for example, the node portion 37B of the second twisted wire portion 36 may not be formed on the second surfaces 11*e* and 11*f* of the winding core portion 11.

In the above embodiment and the modification example, formation positions of the node portions 37B of the second twisted wire portion 36 in the length direction of the third wire 33 and the fourth wire 34 are not limited to positions at equal intervals, and may be at unequal intervals.

Figure 13A:
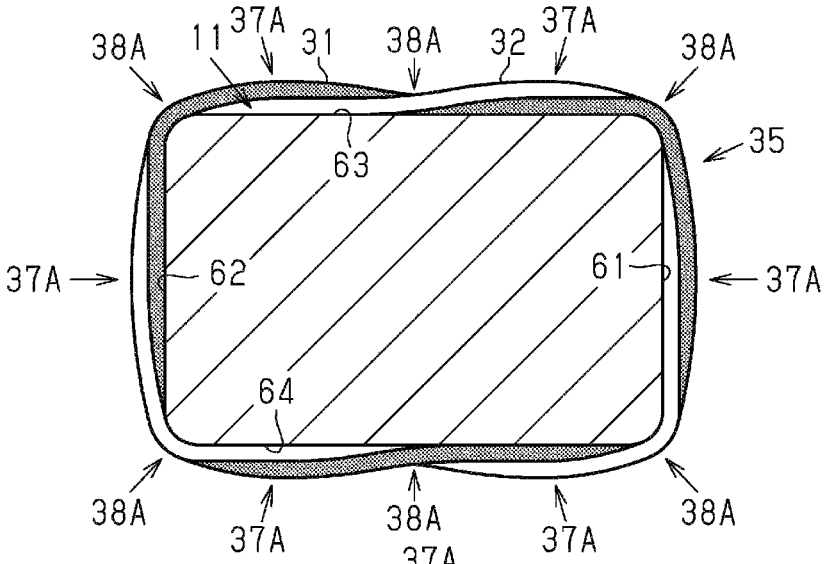
FIG. 13A to FIG. 13C are schematic cross-sectional views illustrating one turn of a winding core portion and a coil of a modification example.

In the above embodiment, the cross-sectional shape of the winding core portion 11 of the core 10 is not limited to a substantially hexagonal shape, and may be arbitrarily changed. For example, the cross-sectional shape of the winding core portion 11 may be a substantially quadrangular shape, a substantially pentagonal shape, or a substantially octagonal shape. For example, as illustrated in FIG. 13A, the winding core portion 11 has the substantially quadrangular cross-sectional shape, and includes side surfaces 61 and 62 that are parallel to each other and that configure the peripheral surface of the winding core portion 11, and a first surface 63 and a second surface 64. The first twisted wire portion 35 constituted of the first wire 31 and the second wire 32 wound around the winding core portion 11 has six node portions 37A in one turn of the coil 30. As illustrated in FIG. 13A, in the first twisted wire portion 35, one node portion 37A is arranged on the side surfaces 61 and 62, and two node portions 37A are arranged on the first surface 63 and the second surface 64. Note that the number of the first twisted wire portions 35 can be arbitrarily changed. In the first twisted wire portion 35, for example, one node portion 37A may be arranged on the first surface 63 and the second surface 64. Further, for example, the number of the node portions 37A of the first twisted wire portion 35 arranged on the first surface 63 may be different from the number of the node portions 37A arranged on the second surface 64.

Figure 13B:
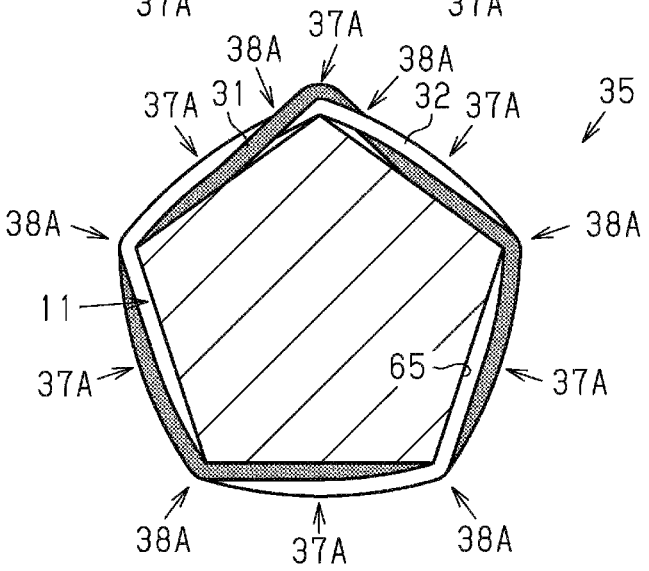

For example, as illustrated in FIG. 13B, the winding core portion 11 has the substantially pentagonal cross-sectional shape and has five peripheral surfaces 65. The first twisted wire portion 35 constituted of the first wire 31 and the second wire 32 wound around the winding core portion 11 has five node portions 37A in one turn of the coil 30. As illustrated in FIG. 13B, in the first twisted wire portion 35, one node portion 37A is arranged on each of the peripheral surfaces 65. Note that the number of node portions 37A of the first twisted wire portion 35 can be arbitrarily changed. For example, a surface on which a plurality of node portions 37A is arranged and a surface on which the node portion 37A is not arranged may be formed on each of the peripheral surfaces 65.

Figure 13C:
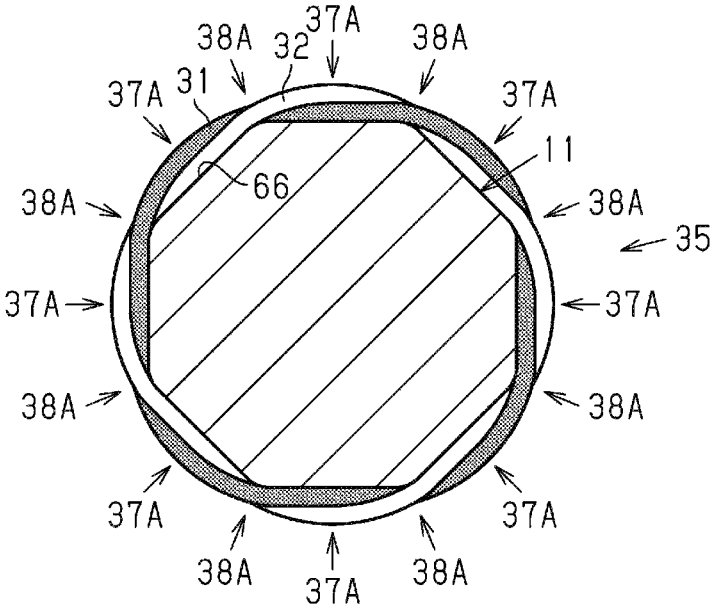

For example, as illustrated in FIG. 13C, the winding core portion 11 has the substantially octagonal cross-sectional shape and has eight peripheral surfaces 66. The first twisted wire portion 35 constituted of the first wire 31 and the second wire 32 wound around the winding core portion 11 has eight node portions 37A in one turn of the coil 30. As illustrated in FIG. 13C, in the first twisted wire portion 35, one node portion 37A is arranged on each of the peripheral surfaces 66. Note that the number of node portions 37A of the first twisted wire portion 35 can be arbitrarily changed. For example, a surface on which a plurality of node portions 37A is arranged and a surface on which the node portion 37A is not arranged may be formed on each of the peripheral surfaces 66.

Figure 14:
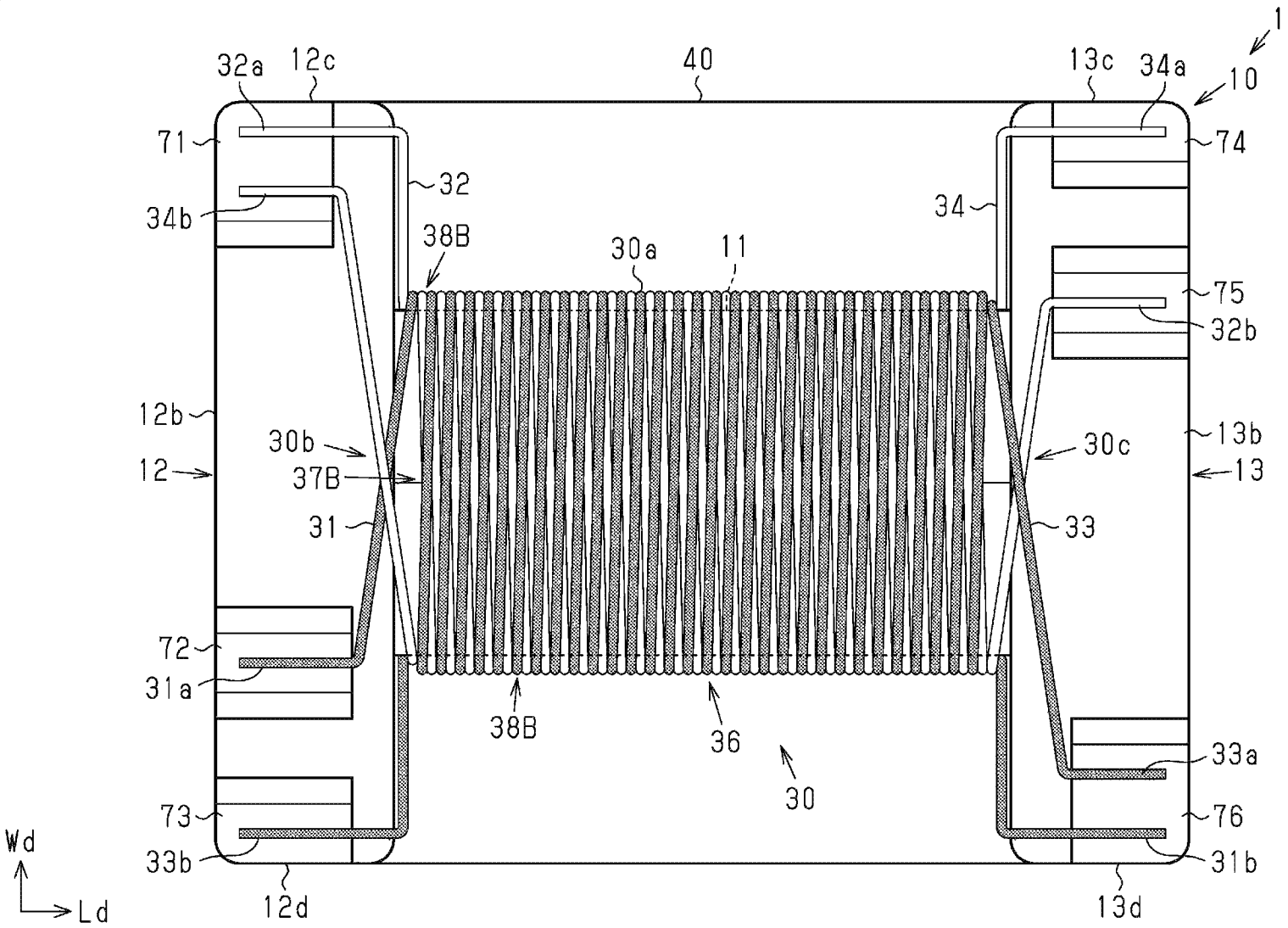
FIG. 14 is a schematic bottom view illustrating a coil component according to a modification example.

In the above embodiment, although the number of terminal electrodes of the coil component 1 is not limited to 8, it may be 6. More specifically, as illustrated in FIG. 14, the first flange portion 12 of the core 10 includes a first terminal electrode 71, a second terminal electrode 72, and a third terminal electrode 73. The second flange portion 13 includes a fourth terminal electrode 74, a fifth terminal electrode 75, and a sixth terminal electrode 76. The one end portion 31*a* of the first wire 31 is connected to the second terminal electrode 72. The other end portion 31*b* of the first wire 31 is connected to the sixth terminal electrode 76. The one end portion 32*a* of the second wire 32 is connected to the first terminal electrode 71. The other end portion 32*b* of the second wire 32 is connected to the fifth terminal electrode 75. The one end portion 33*a* of the third wire 33 is connected to the sixth terminal electrode 76. The other end portion 33*b* of the third wire 33 is connected to the third terminal electrode 73. The one end portion 34*a* of the fourth wire 34 is connected to the fourth terminal electrode 74. The other end portion 34*b* of the fourth wire 34 is connected to the first terminal electrode 71. Thus, even though the coil component 1 is not mounted in or on the circuit substrate PX, the other end portion 31*b* of the first wire 31 is electrically connected to the one end portion 33*a* of the third wire 33, and the one end portion 32*a* of the second wire 32 is electrically connected to the other end portion 34*b* of the fourth wire 34.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a core having a winding core portion;

a first wire and a second wire wound around the winding core portion; and a third wire and a fourth wire wound around an outer side portion of a portion of the first wire and the second wire wound around the winding core portion in a direction opposite to a winding direction of the first wire and the second wire, wherein a portion of the first wire and the second wire wound around the winding core portion has, at least in part, a first twisted wire portion in which the first wire and the second wire are twisted each other, and a length of a portion of an entire single winding of the first wire and the second wire wound around the winding core portion such that the first wire and the second wire are adjacent to each other is configured to be equal to a length of a portion of an entire single winding of the third wire and the fourth wire wound around an outer side portion of a portion of the first wire and the second wire wound around the winding core portion such that the third wire and the fourth wire are adjacent to each other.

2. The coil component according to claim 1, wherein a portion of the third wire and the fourth wire wound around an outer side portion of the first wire and the second wire has, at least in part, a second twisted wire portion in which the third wire and the fourth wire are twisted each other.

3. The coil component according to claim 2, wherein a total number of twists of the first twisted wire portion is larger than a total number of twists of the second twisted wire portion.

4. The coil component according to claim 2, wherein a number of twists per predetermined length of the first twisted wire portion is larger than a number of twists per predetermined length of the second twisted wire portion.

5. The coil component according to claim 1, wherein the coil component is a surface-mount type coil component.

6. The coil component according to claim 1, wherein the first wire, the second wire, the third wire, and the fourth wire form a coil having a horizontal winding structure.

7. The coil component according to claim 1, wherein the first wire and the second wire are electrically insulated from each other in a portion of the first wire and the second wire wound around the winding core portion, and the third wire and the fourth wire are electrically insulated from each other in a portion of the third wire and the fourth wire wound around an outer side portion of the first wire and the second wire.

8. The coil component according to claim 1, wherein the core includes a first flange portion provided at one end portion of the winding core portion and a second flange portion provided at another end portion of the winding core portion, the first flange portion includes a first terminal electrode, a second terminal electrode, a third terminal electrode, and a fourth terminal electrode, the second flange portion includes a fifth terminal electrode, a sixth terminal electrode, a seventh terminal electrode, and an eighth terminal electrode, one end portion of the first wire is connected to the third terminal electrode, another end portion of the first wire is connected to the eighth terminal electrode, one end portion of the second wire is connected to the first terminal electrode, another end portion of the second wire is connected to the sixth terminal electrode, one end portion of the third wire is connected to the seventh terminal electrode, another end portion of the third wire is connected to the fourth terminal electrode, one end portion of the fourth wire is connected to the fifth terminal electrode, and another end portion of the fourth wire is connected to the second terminal electrode.

9. The coil component according to claim 1, wherein the core includes a first flange portion provided at one end portion of the winding core portion and a second flange portion provided at another end portion of the winding core portion, the first flange portion includes a first terminal electrode, a second terminal electrode, and a third terminal electrode, the second flange portion includes a fourth terminal electrode, a fifth terminal electrode, and a sixth terminal electrode, one end portion of the first wire is connected to the second terminal electrode, another end portion of the first wire is connected to the sixth terminal electrode, one end portion of the second wire is connected to the first terminal electrode, another end portion of the second wire is connected to the fifth terminal electrode, one end portion of the third wire is connected to the sixth terminal electrode, another end portion of the third wire is connected to the third terminal electrode, one end portion of the fourth wire is connected to the fourth terminal electrode, another end portion of the fourth wire is connected to the first terminal electrode.

10. The coil component according to claim 1, wherein the winding core portion has a substantially polygonal cross section cut by a plane orthogonal to a direction in which the winding core portion extends, and in a case where a portion in which the first wire and the second wire do not overlap each other is set as a belly portion when viewed from a direction orthogonal to a peripheral surface of the winding core portion, a belly portion of the first twisted wire portion is positioned at a corner portion of the winding core portion.

11. The coil component according to claim 3, wherein a number of twists per predetermined length of the first twisted wire portion is larger than a number of twists per predetermined length of the second twisted wire portion.

12. The coil component according to claim 2, wherein the coil component is a surface-mount type coil component.

13. The coil component according to claim 3, wherein the coil component is a surface-mount type coil component.

14. The coil component according to claim 2, wherein the first wire, the second wire, the third wire, and the fourth wire form a coil having a horizontal winding structure.

15. The coil component according to claim 3, wherein the first wire, the second wire, the third wire, and the fourth wire form a coil having a horizontal winding structure.

16. The coil component according to claim 2, wherein the first wire and the second wire are electrically insulated from each other in a portion of the first wire and the second wire wound around the winding core portion, and the third wire and the fourth wire are electrically insulated from each other in a portion of the third wire and the fourth wire wound around an outer side portion of the first wire and the second wire.

17. The coil component according to claim 3, wherein the first wire and the second wire are electrically insulated from each other in a portion of the first wire and the second wire wound around the winding core portion, and the third wire and the fourth wire are electrically insulated from each other in a portion of the third wire and the fourth wire wound around an outer side portion of the first wire and the second wire.

18. The coil component according to claim 2, wherein the core includes a first flange portion provided at one end portion of the winding core portion and a second flange portion provided at another end portion of the winding core portion, the first flange portion includes a first terminal electrode, a second terminal electrode, a third terminal electrode, and a fourth terminal electrode, the second flange portion includes a fifth terminal electrode, a sixth terminal electrode, a seventh terminal electrode, and an eighth terminal electrode, one end portion of the first wire is connected to the third terminal electrode, another end portion of the first wire is connected to the eighth terminal electrode, one end portion of the second wire is connected to the first terminal electrode, another end portion of the second wire is connected to the sixth terminal electrode, one end portion of the third wire is connected to the seventh terminal electrode, another end portion of the third wire is connected to the fourth terminal electrode, one end portion of the fourth wire is connected to the fifth terminal electrode, and another end portion of the fourth wire is connected to the second terminal electrode.

19. The coil component according to claim 2, wherein the core includes a first flange portion provided at one end portion of the winding core portion and a second flange portion provided at another end portion of the winding core portion, the first flange portion includes a first terminal electrode, a second terminal electrode, and a third terminal electrode, the second flange portion includes a fourth terminal electrode, a fifth terminal electrode, and a sixth terminal electrode, one end portion of the first wire is connected to the second terminal electrode, another end portion of the first wire is connected to the sixth terminal electrode, one end portion of the second wire is connected to the first terminal electrode, another end portion of the second wire is connected to the fifth terminal electrode, one end portion of the third wire is connected to the sixth terminal electrode, another end portion of the third wire is connected to the third terminal electrode, one end portion of the fourth wire is connected to the fourth terminal electrode, another end portion of the fourth wire is connected to the first terminal electrode.

20. The coil component according to claim 2, wherein the winding core portion has a substantially polygonal cross section cut by a plane orthogonal to a direction in which the winding core portion extends, and in a case where a portion in which the first wire and the second wire do not overlap each other is set as a belly portion when viewed from a direction orthogonal to a peripheral surface of the winding core portion, a belly portion of the first twisted wire portion is positioned at a corner portion of the winding core portion.

* * * * *